US005196293A

United States Patent [19]

Okamura et al.

[11] Patent Number: 5,196,293

[45] Date of Patent: Mar. 23, 1993

[54] SILVER HALIDE PHOTOGRAPHIC MATERIAL

[75] Inventors: Hisashi Okamura; Kazunobu Katoh; Shoji Yasuda; Takashi Hoshimiya, all of Kanagawa, Japan

[73] Assignee: Fuji Photo Film Co., Ltd., Kanagawa, Japan

[21] Appl. No.: 821,217

[22] Filed: Jan. 15, 1992

[30] Foreign Application Priority Data

Jan. 17, 1991 [JP] Japan ..... 3-15648
Mar. 12, 1991 [JP] Japan ..... 3-70388

[51] Int. Cl.[5] ..... G03C 1/06; G03C 1/34

[52] U.S. Cl. ..... 430/264; 430/223; 430/544; 430/614; 430/957

[58] Field of Search ..... 430/544, 614, 957, 264, 430/223

[56] References Cited

U.S. PATENT DOCUMENTS 5,085,971 2/1992 Katoh et al. ..... 430/544
5,132,201 7/1992 Yagihara et al. ..... 430/264
5,134,055 7/1992 Okamura et al. ..... 430/264

FOREIGN PATENT DOCUMENTS 0335319 10/1989 European Pat. Off. .
0393711 10/1990 European Pat. Off. .

*Primary Examiner*—Richard L. Schilling
*Attorney, Agent, or Firm*—Sughrue, Mion, Zinn, Macpeak & Seas

[57] ABSTRACT

A silver halide photographic material comprising a support having thereon at least one silver halide emulsion layer, wherein the silver halide photographic material contains at least one compound represented by formula (I):

$$ED\text{-}(Time)_t\text{-}Ind \quad (I)$$

wherein ED represents a group capable of releasing $(Time)_t$-Ind upon a reaction with an oxidation product of a developing agent; Time represents a divalent linking group; t represents 0 to 1; and Ind represents a group represented by formula (II):

(II)

wherein X represents a monovalent group; and s represents an integer of from 0 to 4.

The compound represented by formula (I) is excellent in preservability and rapidly releases a development inhibitor.

The silver halide photographic material provides an ultrahigh contrast image using a highly stable developing solution and is particularly suitable for use in photomechanical processes.

14 Claims, No Drawings

SILVER HALIDE PHOTOGRAPHIC MATERIAL

FIELD OF THE INVENTION

The present invention relates to a silver halide photographic material and a method of forming an ultra-high contrast negative image using the same and, more particularly, to an ultrahigh contrast negative type silver halide photographic material suitable for use in the field of photomechanical processes.

BACKGROUND OF THE INVENTION

In the field of photomechanical processes, there is a demand for light-sensitive materials having satisfactory image reproducibility of originals, stability of processing solutions, and simplification of replenishment, in order to cope with the recent diversity and complexity of printed materials.

In particular, originals in line work comprise photocomposed letters, hand-written letters, illustrations, dot prints, etc., and thus contain images having different densities or line widths. There has therefore been a keen demand to develop a process camera, a light-sensitive material or an image formation system which enables one to reproduce the original with good reproducibility. In the photomechanical process of catalogues or large posters, on the other hand, enlargement or reduction of a dot print is widely conducted. When a dot print is enlarged in plate making, the line number becomes small and the dots are blurred. When a dot print is reduced, the line number/inch ratio becomes larger and the dots become finer than the original. Accordingly, an image formation system having a broader latitude has been needed to maintain reproducibility of halftone gradation.

A halogen lamp or a xenon lamp is employed as a light source of a process camera. In order to obtain photographic sensitivity to these light sources, photographic materials are usually subjected to orthochromatic sensitization. However, orthochromatic photographic materials are more susceptible to the influences of chromatic aberration of the lens and thus susceptible to image quality deterioration. The deterioration is conspicuous when using a xenon lamp as a light source.

Known systems meeting the demand for a broad latitude include a method of processing a lith type silver halide light-sensitive material containing silver chlorobromide (containing at least 50% of silver chloride) with a hydroquinone developing solution having an extremely low effective sulfite ion concentration (usually 0.1 mol/l or less). One may obtain thereby a line or dot image having high contrast and high density in which image areas and non-image areas are clearly distinguished. According to this method, however, development is extremely unstable against air oxidation due to the low sulfite concentration of the developing solution. Hence, various efforts and devices are required to stabilize the developing activity and, at the present time, the processing speed is considerably low thereby reducing working efficiency.

There has thus been a demand to find an image formation system which eliminates the image formation instability associated with the above-described lith development system and provides an ultrahigh contrast image by using a processing solution having satisfactory preservation stability. In this connection, it has been proposed to process a surface latent image type silver halide photographic material containing a specific acylhydrazine compound with a developing solution having a pH between 11.0 and 12.3 and containing at least 0.15 mol/l of a sulfite preservative and thereby exhibiting satisfactory preservation stability to form an ultrahigh contrast negative image having a gamma value exceeding 10, as described in U.S. Pat. Nos. 4,166,742, 4,168,977, 4,221,857, 4,224,401, 4,243,739, 4,272,606, and 4,311,781. This new image formation system is characterized by the fact that silver iodobromide and silver chloroiodobromide as well as silver chlorobromide, are applicable thereto, whereas the conventional ultrahigh contrast image formation systems are only applicable to photographic materials comprising silver chlorobromide having a high silver chloride content.

While the above-described image formation system exhibits excellent performance in dot quality, stability of processing, rapidness of processing, and reproducibility of originals, a system which provides further improved reproducibility of originals has been desired in order to cope with the recent diversity of printed materials.

An attempt to broaden gradation reproducing area has been made using a light-sensitive material containing a redox compound capable of releasing a development inhibitor upon being oxidized as described in JP-A-61-213847 (the term "JP-A" as used herein means an "unexamined published Japanese patent application") JP-A-62-260153, JP-A-64-88451, JP-A-64-72140, and U.S. Pat. No. 4,684,604. However, when in an ultrahigh contrast image formation system using a hydrazine derivative, these redox compounds are employed in light-sensitive materials in amounts sufficient for improving reproducibility of line image and reproducibility of dot image, a portion of development inhibitors released during development are discharged from the light-sensitive materials. During continuous processing of a large amount of the light-sensitive materials containing these redox compounds the development inhibitors accumulate in the developing solution. As a result, when a light-sensitive material is subjected to development processing using such a fatigued developing solution, the capacity to make a high contrast is damaged and a decrease in sensitivity occurs. Particularly, when one automatic developing machine is employed for development of light-sensitive materials containing such redox compounds together with other light sensitive materials (for example, those for photographing, those for contact printing and those for a scanner), the photographic properties of such other light-sensitive materials are adversely affected.

Therefore, a sufficiently large benefit cannot be obtained, or only a closed system wherein light-sensitive materials and developing solutions to be used are restricted to a narrow range since the amount of the redox compound used is limited. Thus, there has been a desire to solve such problems.

SUMMARY OF THE INVENTION

Therefore, an object of the present invention is to provide a novel compound which is excellent in preservation stability and capable of rapidly releasing a development inhibitor.

Another object of the present invention is to provide a compound which controls fatigue of the developing solution to a low level when the compound is used in a light-sensitive material for a high contrast system in an amount sufficient for improving reproducibility of images.

Still another object of the present invention is to provide a light-sensitive material for plate making which provides a high contrast image using a highly stable developing solution.

A further object of the present invention is to provide a light-sensitive material for plate making which uses a hydrazine nucleating agent and has high contrast and broad halftone gradation.

A still further object of the present invention is to provide a light-sensitive material for plate making which has a stable running processing aptitude.

Other objects of the present invention will become apparent from the following detailed description and examples.

These objects of the present invention are accomplished by a silver halide photographic material comprising a support having thereon at least one silver halide emulsion layer, wherein the silver halide photographic material contains at least one compound represented by formula (I):

$$ED\text{-}(Time)_t\text{-}Ind \quad (I)$$

wherein ED represents a group capable of releasing $(Time)_t$-Ind upon a reaction with an oxidation product of a developing agent; Time represents a divalent linking group; t represents 0 or 1; and Ind represents a group represented by formula (II):

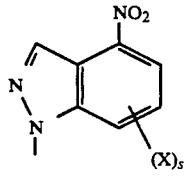

(II)

wherein X represents a monovalent group; and s represents an integer of from 0 to 4.

DETAILED DESCRIPTION OF THE INVENTION

The compound represented by formula (I) according to the present invention will be described in greater detail below.

In formula (I), ED represents a group capable of releasing $(Time)_t$-Ind upon a reaction with an oxidation product of a developing agent as described above. Examples of that group include a group which releases $(Time)_t$- Ind upon a coupling reaction with an oxidation product of an aromatic amine developing agent and a group which releases $(Time)_t$-Ind through one or more reaction stages after being oxidized by an oxidation product of various kinds of developing agents.

ED preferably represents a redox group. Examples of preferred redox groups include a hydroquinone moiety, a catechol moiety, a naphthohydroquinone moiety, an aminophenol moiety, a pyrazolidone moiety, a hydrazine moiety, a hydroxylamine moiety or a reduction moiety. A hydrazine moiety is particularly preferred.

Among the compounds represented by formula (I), those represented by formula (III) are preferred:

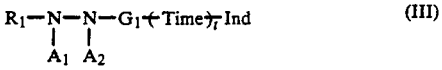

(III)

wherein Time, t and Ind each has the same meaning as in formula (I); $R_1$ represents an aliphatic group or an aromatic group; $G_1$ represents —CO—, —COCO—, —CS—,

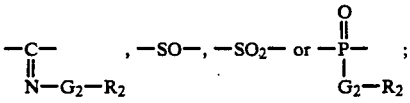

$G_2$ represents a mere bond, —O—, —S— or

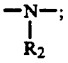

$R_2$ represents a hydrogen atom, an aliphatic group or an aromatic group and when two or more $R_2$ groups are present, they may be the same or different; and one of $A_1$ and $A_2$ represents a hydrogen atom; and the other represents a hydrogen atom, an acyl group, an alkylsulfonyl group or an arylsulfonyl group.

The aliphatic group represented by $R_1$ in formula (III) includes a straight chain, branched chain or cyclic alkyl group containing preferably from 1 to 30 carbon atoms, more preferably from 1 to 20 carbon atoms. The alkyl group may have one or more substituents.

The aromatic group represented by $R_1$ in formula (III) includes a monocyclic or bicyclic aryl group and an unsaturated heterocyclic group. The unsaturated heterocyclic group may be condensed with an aryl group to form a heteroaryl group. Specific examples of the aromatic ring include a benzene ring, a naphthalene ring, a pyridine ring, a quinoline ring, and an isoquinoline ring. Among them, those including a benzene ring are preferred.

$R_1$ is particularly preferably an aryl group.

The aryl group or unsaturated heterocyclic group represented by $R_1$ may be substituted with one or more substituents. Representative examples of the substituents include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxy group, and a phosphonamido group. Preferred examples of the substituents include a straight chain, branched chain or cyclic alkyl group (preferably having from 1 to 20 carbon atom), an aralkyl group (preferably having from 7 to 30 carbon atoms), an alkoxy group (preferably having from 1 to 30 carbon atoms), a substituted amino group (preferably an amino group substituted with an alkyl group having from 1 to 30 carbon atoms), an acylamino group (preferably having from 2 to 40 carbon atoms), a sulfonamido group (preferably having from 1 to 40 carbon atoms), a ureido group (preferably having from 1 to 40 carbon atoms) and a phosphonamido group (preferably having from 1 to 40 carbon atoms).

In formula (III), $G_1$ is preferably —CO— or —$SO_2$—, and more preferably —CO—.

In formula (III), $A_1$ and $A_2$ are preferably hydrogen atoms.

In formula (I) or (III), Time represents a divalent linking group and may have a timing control function.

When the divalent linking group represented by Time has a timing control function, Time represents a group which releases Ind through one or more reaction stages from Time-Ind which has been released from ED.

The divalent linking groups represented by Time include, for example, those capable of releasing Ind upon an intramolecular ring-closing reaction of a p-nitrophenoxy derivative as described, for example, in U.S. Pat. No. 4,248,962 (corresponding to JP-A-54-145135); those capable of releasing Ind upon an intramolecular ring closing reaction after ring cleavage as described, for example, in U.S. Pat. Nos. 4,310,612 (corresponding to JP-A-55-53330) and 4,358,525; those capable of releasing Ind accompanied with the formation of an acid anhydride upon an intramolecular ring closing reaction of a carboxy group of succinic acid monoester or an analogue thereof as described, for example, in U.S. Pat. Nos. 4,330,617, 4,446,216 and 4,483,919 and JP-A-59-121328; those capable of releasing Ind accompanied with the formation of quinomonomethane or an analogue thereof upon electron transfer via conjugated double bonds of an aryloxy group or a heterocyclic oxy group as described, for example, in U.S. Pat. Nos. 4,409,323 and 4,421,845, *Research Disclosure,* No. 21228 (December, 1981), U.S. Pat. No. 4,416,977 (JP-A-57-135944), JP-A-58-209736 and JP-A-58-209738; those capable of releasing Ind from the γ-position of an enamine upon electron transfer in the enamine structure portion of a nitrogen-containing hetero ring as described, for example, in U.S. Pat. No. 4,420,554 (corresponding to JP-A-57-136640), JP-A-57-135945, JP-A-57-188035, JP-A-58-98728 and JP-A-58-209737; those capable of releasing Ind upon an intramolecular ring-closing reaction of an oxy group formed by electron transfer to a carbonyl group which is conjugated with a nitrogen atom in a nitrogen-containing hetero ring as described, for example, in JP-A-57-56837; those capable of releasing Ind accompanied with the formation of an aldehyde as described, for example, in U.S. Pat. No. 4,146,396 (corresponding to JP-A-52-90932), JP-A-59-93442, JP-A-59 75475, JP-A-60-249148 and JP-A-60-249149; those capable of releasing Ind accompanied with decarboxylation of carboxy group as described, for example, in JP-A-51-146828, JP-A-57-179842 and JP-A-59-104641; those capable of releasing Ind from a structure of —O—COOCRaRb-Ind (wherein Ra and Rb each represents a monovalent group) accompanied with decarboxylation and the subsequent formation of an aldehyde; those capable of releasing Ind accompanied with the formation of isocyanate as described, for example, in JP-A-60-7429; and those capable of releasing Ind upon a coupling reaction with an oxidation product of a color developing agent as described, for example, in U.S. Pat. No. 4,438,193.

Specific examples of the divalent linking group represented by Time are described in detail, for example, in JP-A-61-236549 and JP-A-1-269936 and Japanese Patent Application No. 2-93487.

Ind represented by formula (II) will be described below.

In formula (II), s represents an integer of from 0 to 4, preferably 0, 1 or 2.

Suitable examples of the monovalent group represented by X include, for example, a nitro group and a nitroso group, as well as the substituents described for $R_1$ in formula (III).

Of the aliphatic groups represented by X, a straight chain, branched chain or cyclic alkyl group having from 1 to 10 carbon atoms, an alkenyl group and an alkynyl group are preferred. An aralkyl group having from 7 to 10 carbon atoms wherein an alkyl group is substituted with an aryl group is also preferred. Specific examples of the preferred aliphatic groups include a methyl group, an ethyl group, an isopropyl group, a tert-butyl group and a benzyl group.

Of the aromatic groups represented by X, an aryl group having from 6 to 10 carbon atoms and an unsaturated heterocyclic group having from 5 to 10 carbon atoms are preferred. These groups may be substituted. Suitable examples of the substituents include those described for the monovalent group represented by X. Specific examples of the preferred aromatic groups include a substituted or unsubstituted phenyl group, a substituted or unsubstituted naphthyl group, a substituted or unsubstituted pyrizyl group, a substituted or unsubstituted quinolyl group and a substituted or unsubstituted isoquinolyl group.

Specific examples of Ind useful in the present invention are set forth below, but the present invention should not be construed as being limited thereto:

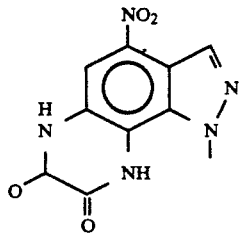

Ind-1

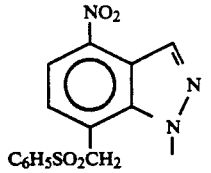

Ind-2

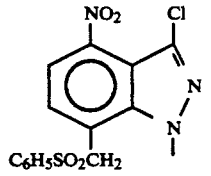

Ind-3

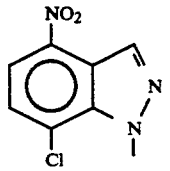

Ind-4

-continued
Ind-5
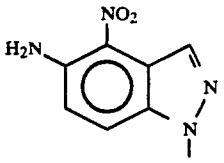
Ind-6
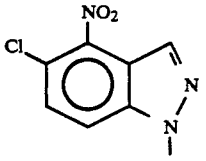
Ind-7
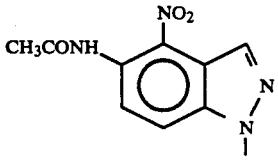
Ind-8
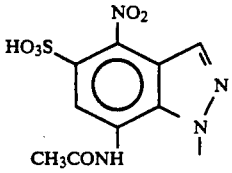
Ind-9
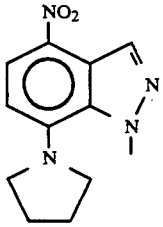
Ind-10
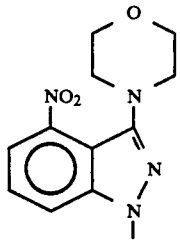
Ind-11
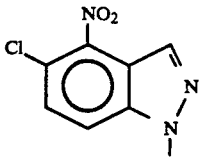
Ind-12
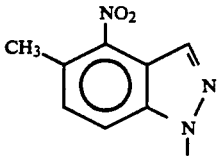
-continued
Ind-13
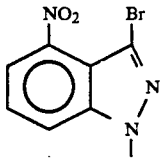
Ind-14
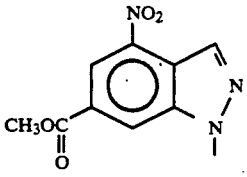
Ind-15
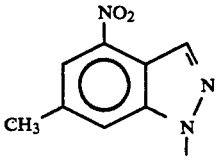
Ind-16
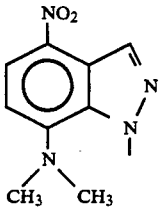
Ind-17
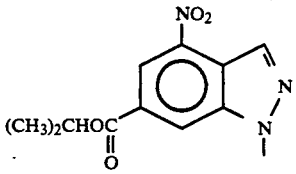
Ind-18
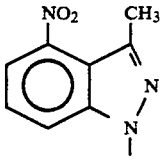
Ind-19
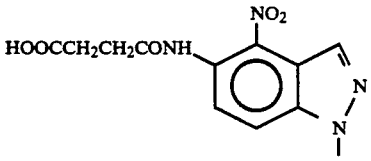
Ind-20
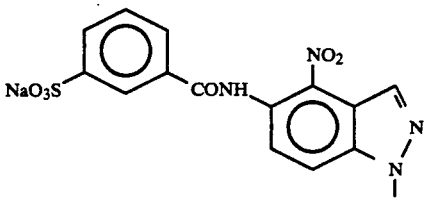
The Ind compound can be synthesized in the form of Ind-H by synthesis of an indazole ring and subsequent introduction of a functional group such as a nitro group, or by completion of indazole ring using an alkylaniline having a functional group such as a nitro group.

Representative examples for synthesis of the Ind compounds are illustrated below.

Synthesis of Ind-7-H

To a mixture of 8.8 g of 5-acetamidoindazole and 100 ml of acetic acid was added 8.0 ml of nitric acid (specific gravity: 1.38), and the mixture was stirred for 3 hours at 80° C. After cooling to room temperature, the crystals thus deposited were collected by filtration, washed with water and dried to obtain the desired compound. Yield: 7.8 g.

Synthesis of Ind-11-H 15.2 g of 3-nitro-o toluidine was dissolved in 0.5 liters of acetic acid, and to the resulting solution was added 10 ml of an aqueous solution containing 4.6 g of sodium sulfite. After stirring for one hour, the mixture was allowed to stand for 4 days. The volatile components were distilled off under a reduced pressure. To the residue was added water and the crystals thus deposited were collected by filtration and recrystallized from a solvent mixture of methanol and water to obtain the desired compound. Yield: 8.7 g.

ED or Time in formula (I) or $R_1$ or Time in formula (III) may include a ballast group which is conventionally employed in immobile photographic additives such as couplers, or a group which is capable of accelerating the adsorption of the compound represented by formula (I) or (III) onto silver halide.

The ballast group is an organic group which provides a molecular weight sufficient for substantially preventing the compound represented by formula (I) or (III) from diffusing into other layers or the processing solution. The ballast group includes, for example, an alkyl group, an aryl group, a heterocyclic group, an ether group, a thioether group, an amido group, a ureido group, a urethane group, a sulfonamido group or a combination of two or more thereof. The ballast group is preferably a ballast group containing a substituted benzene ring, and particularly a ballast group containing a benzene ring substituted with a branched alkyl group.

The adsorption accelerating group for silver halide includes a cyclic thioamido group (for example, 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxadiazoline-2-thione, benzimidazoline-2-thione, benzoxazoline-2-thione, benzothiazoline-2-thione, thiotriazine and 1,3-imidazoline-2-thione), a chain thioamido group, an aliphatic mercapto group, an aromatic mercapto group, a heterocyclic mercapto group (when the atom adjacent to the carbon atom bonded to —SH group is a nitrogen atom, the mercapto group has the same meaning as a cyclic thioamide group which is in a tautomeric relation therewith and specific examples thereof are same as mentioned above), a group having a disulfido bond, a 5-membered or 6-membered nitrogen-containing heterocyclic rings comprising a combination of nitrogen, oxygen, sulfur, and carbon (for example, benzotriazole, triazole, tetrazole, indazole, benzimidazole, imidazole, benzothiazole, thiazole, thiazoline, benzoxazole, oxazole, oxazoline, thiadiazole, oxadiazole, triazine and azaindene), and a heterocyclic quaternary salt (for example, benzimidazolinium).

The ballast group and adsorption accelerating group may be further substituted with one or more appropriate substituents. The substituents can be selected from those described for $R_1$ in formula (III) above.

Specific examples of the compound according to formula (I) or (III) in the present invention are shown below, but the present invention is not to be construed as being limited to these compounds:

(1)

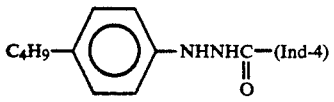

(2)

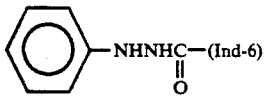

(Ind-7)(3)

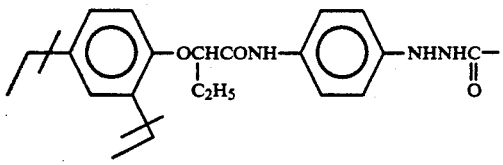

(4)

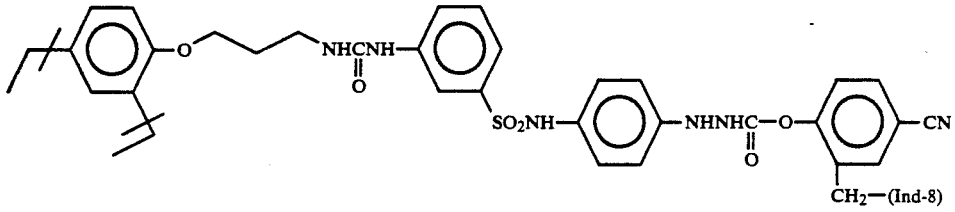

-continued
(5)
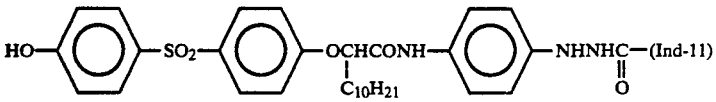
(6)
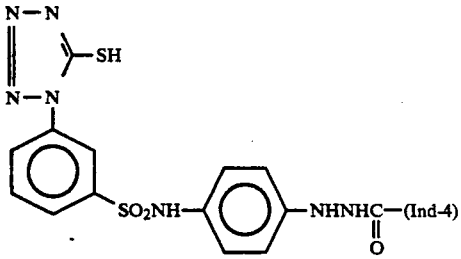
(7)
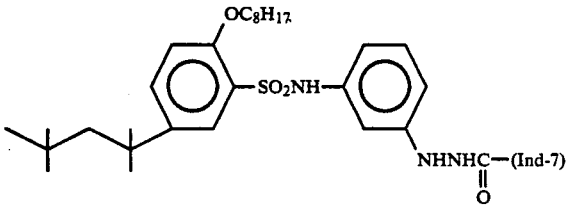
(8)
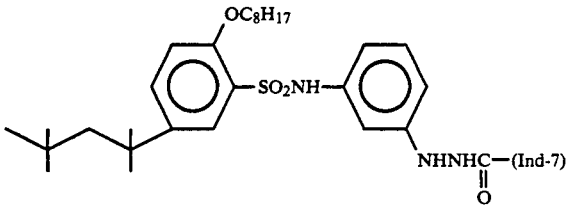
(9)
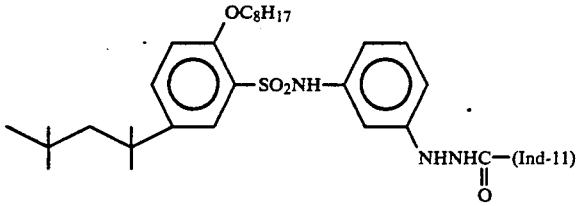
(10)
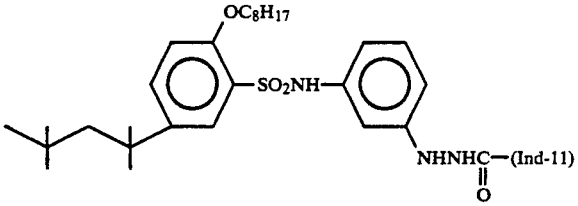
(Ind-11)
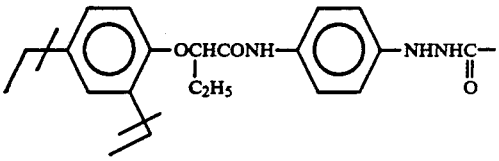
(12)
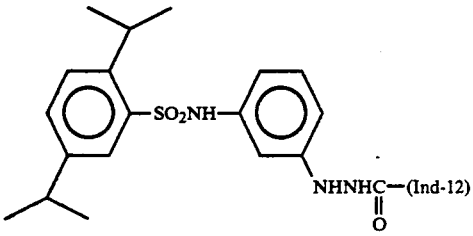

-continued
(13)
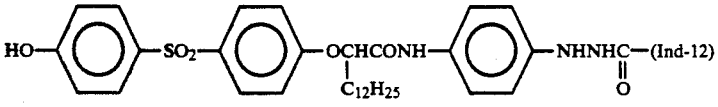
(14)
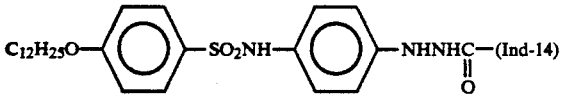
(15)
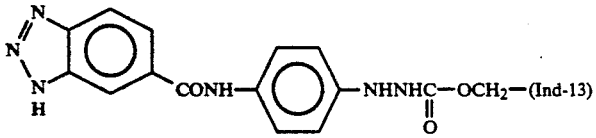
(16)
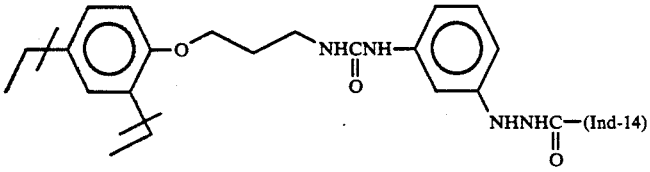
(17)
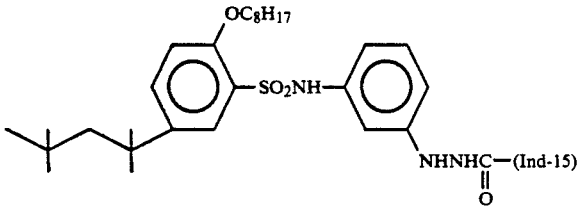
(18)
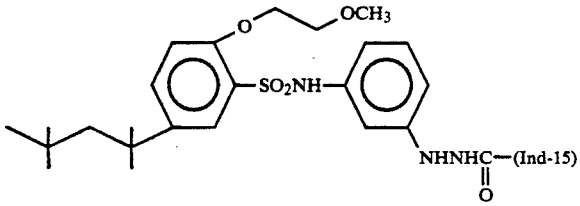
(19)
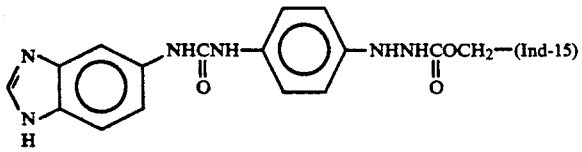
(20)
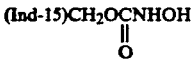
(21)
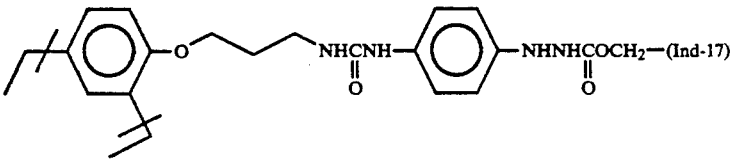

-continued (22)

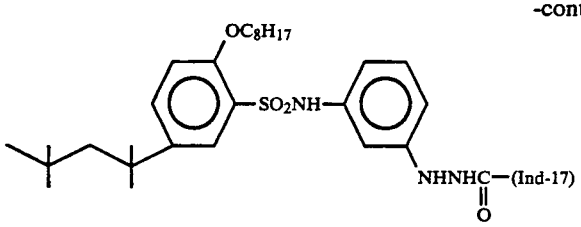

(23)

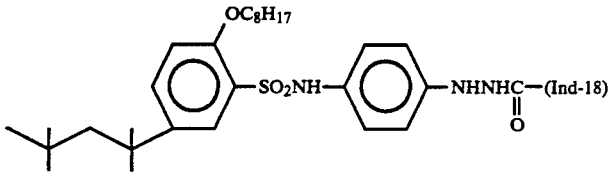

(24)

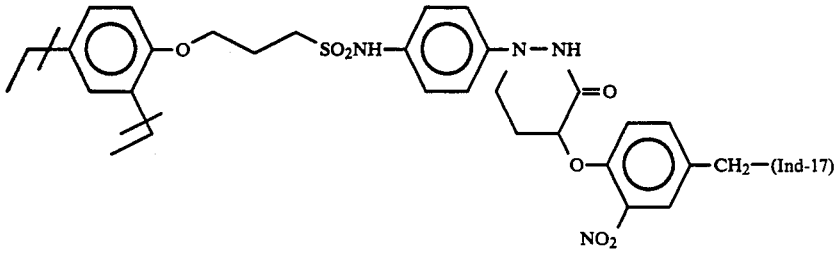

(25)

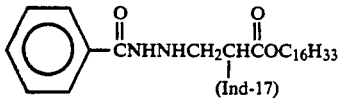

(26)

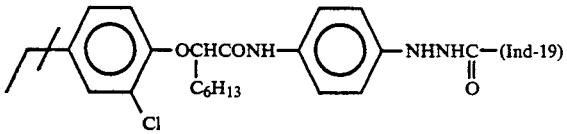

The compound represented by formula (III) according to the present invention can be generally synthesized according to Synthesis Route 1 wherein two equivalents of a corresponding Ind-(Time)$_r$-H are reacted with trichloromethyl chlorocarbonate in an organic solvent such as tetrahydrofuran in the presence of a base such as triethylamine to prepare a symmetrical carbonyl compound. The resulting compound is reacted with a corresponding hydrazine compound. Alternatively, in Synthesis Route 2, a corresponding Ind-(Time)$_r$-H is condensed with p-nitrophenyl chlorocarbonate in the presence of a base, and the resulting compound is reacted with a corresponding hydrazine compound as illustrated below.

Synthesis Route 1:

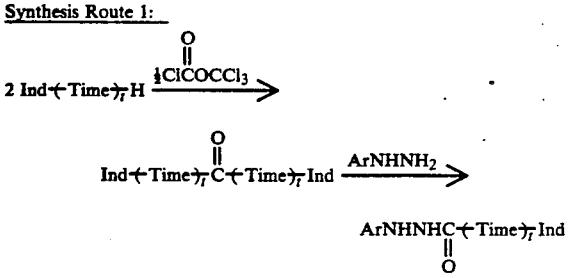

Synthesis Route 2:

-continued

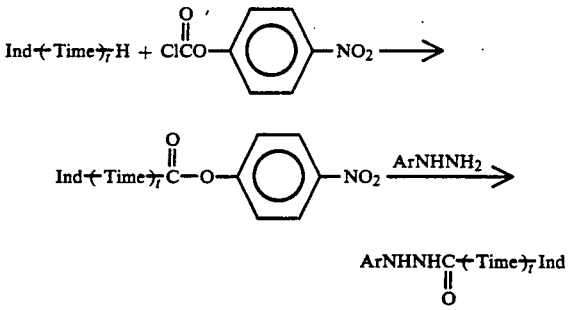

While synthesis methods of the compounds used in the present invention are specifically described, for example, in JP-A-61 213847, JP-A-62-260153, JP-A-3-39949, U.S. Pat. No. 4,684,604, Japanese Patent Application Nos. 2-62337 and 2-64717, synthesis examples thereof are further described below.

SYNTHESIS EXAMPLE 1

Synthesis of Compound 10

To a mixture of 16.3 g of Ind-11-H and 350 ml of tetrahydrofuran was added 3.0 ml of trichloromethyl chloroformate at −10° C. To the resulting mixture was added dropwise 14.0 ml of triethylamine over a period of 30 minutes while maintaining the temperature between −10° C. and 0° C. Then the temperature was raised to room temperature and the mixture was stirred for two hours. After cooling again to −10° C., to the mixture were added 27.0 g of Compound-1 shown below and then 7.0 ml of triethylamine over a period of 10 minutes. The temperature was raised to room temperature and the mixture was stirred for 3 hours allowed to stand overnight. The reaction mixture was poured into 0.5N hydrochloric acid and extracted with ethyl acetate. The ethyl acetate layer was washed with a saturated aqueous solution of sodium chloride, and the volatile components were distilled off. The residue was purified by column chromatography to obtain Compound 10. Yield: 23.2 g. The chemical structure of the compound was identified by NMR spectrum and IR spectrum.

Compound-1:

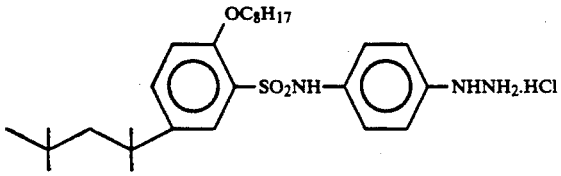

The compound according to the present invention is generally employed in a range of from $1\times10^{-6}$ to $5\times10^{-2}$ mol, preferably from $1\times10^{-5}$ to $1\times10^{-2}$ mol, per mol of silver halide.

The compound according to the present invention can be employed by dissolving it in an appropriate water-miscible organic solvent, for example, an alcohol (e.g., methanol, ethanol, propanol, or a fluorinated alcohol), a ketone (e.g., acetone, or methyl ethyl ketons, dimethylformamide, dimethylsulfoxide, or methyl cellosolve.

Also, it can be employed by dissolving it in an oil such as dibutyl phthalate, tricresyl phosphate, glycerol triacetate, or diethylphthalate together with an auxiliary solvent such as ethyl acetate, or cyclohexanone and dispersing the resulting solution mechanically to form an emulsified dispersion according to an emulsified dispersion method well known in the art. Further, the powdered compound can be employed by dispersing it in water using a ball mill, a colloid mill or ultrasonic wave according to a solid dispersion method known in the art.

The compound according to the present invention can be added to a silver halide emulsion layer or other hydrophilic colloid layer. Also, when several silver halide emulsion layers are present, the compound may be added to one or more layers thereof. Suitable examples of layer composition are illustrated below, but the present invention is not to be construed as being limited thereto. Further, a different hydrazine compound other than the compound represented by formula (I) may be contained in a silver halide emulsion layer (i.e., an image forming layer) or another hydrophilic colloid layer (e.g., a hydrophilic colloid layer adjacent thereto).

Layer Constitution 1

A silver halide emulsion layer containing the compound according to the present invention and a protective layer are provided on a support. The emulsion layer or protective layer may contain a different hydrazine compound as a nucleating agent.

Layer Constitution 2

The first silver halide emulsion layer and the second silver halide emulsion layer are provided on a support in this order. The first silver halide emulsion layer or a hydrophilic layer adjacent thereto contains a different hydrazine compound as a nucleating agent and the second silver halide emulsion layer or a hydrophilic layer adjacent thereto contains the compound according to the present invention.

Layer Constitution 3

The same as Layer Constitution 2 except that the order of two emulsion layers is reversed.

Between the two light-sensitive emulsion layers in Layer Constitutions 2 and 3, an intermediate layer containing gelatin or a synthetic polymer (e.g., polyvinyl acetate, or polyvinyl alcohol) may be provided.

Layer Constitution 4

A silver halide emulsion layer containing a different hydrazine compound as a nucleating agent is provided on a support. On the silver halide emulsion layer or between the support and the silver halide emulsion layer there is provided a hydrophilic layer containing the compound according to the present invention.

Among the above layer compositions, Layer Constitutions 2 and 3 are particularly preferred.

The different hydrazine compound which can be used in the present invention is preferably a compound represented by formula (IV):

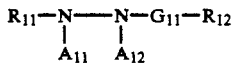

(IV)

wherein $R_{11}$ represents an aliphatic group or an aromatic group; $R_{12}$ represents a hydrogen atom, an alkyl group, an aryl group, an alkoxyl group, an aryloxy group, an amino group or a hydrazino group; $G_{11}$ represents —CO—, —$SO_2$—, —SO—,

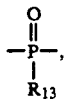

—COCO—, a thiocarbonyl group or an iminomethylene group; $A_{11}$ and $A_{12}$ each represents a hydrogen atom, or one of $A_{11}$ and $A_{12}$ represents a hydrogen atom, and the other represents a substituted or unsubstituted alkylsulfonyl group, a substituted or unsubstituted arylsulfonyl group, or a substituted or unsubstituted acyl group; and $R_{13}$ has the same meaning as defined for $R_{12}$ and may be the same as or different from $R_{12}$.

In formula (IV), the aliphatic group represented by $R_{11}$ is preferably an aliphatic group having from 1 to 30 carbon atoms, and more preferably a straight chain, branched or cyclic alkyl group having from 1 to 20 carbon atoms. The alkyl group may be substituted.

The aromatic group represented by $R_{11}$ in formula (IV) is a monocyclic or bicyclic aryl group or an unsaturated heterocyclic group. The unsaturated heterocyclic group may be condensed with an aryl group.

$R_{11}$ preferably represents an aryl group, and particularly an aryl group containing a benzene ring.

The aliphatic group or aromatic group represented by $R_{11}$ may be substituted. Representative examples of these substituents include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxy group, a halogen atom, a cyano group, a sulfo group, an aryloxycarbonyl group, an acyl group, an alkoxycarbonyl group, an acyloxy group, a carbonamido group, a sulfonamido group, a carboxy group, a phosphonamido group, a diacylamino group, an imido group, and a

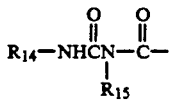

group (wherein $R_{14}$ and $R_{15}$, which may be the same or different, each has the same meaning as defined for $R_{12}$ above). Preferred examples of the substituents include an alkyl group (preferably having from 1 to 20 carbon atoms), an aralkyl group (preferably having from 7 to 30 carbon atoms), an alkoxyl group (preferably having from 1 to 20 carbon atoms), a substituted amino group (preferably an amino group substituted with an alkyl group having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms), and a phosphonamido group (preferably having from 1 to 30 carbon atoms). These groups may be further substituted.

The alkyl group represented by $R_{12}$ in formula (IV) preferably contains from 1 to 4 carbon atoms.

The aryl group represented by $R_{12}$ preferably includes a monocyclic or bicyclic aryl group, such as those containing a benzene ring.

Where $G_{11}$ is —CO—, $R_{12}$ preferably represents an alkyl group (e.g., methyl, trifluoromethyl, 3-hydroxypropyl, 3-methanesulfonamidopropyl, and phenylsulfonylmethyl), an aralkyl group (e.g., o-hydroxybenzyl), or an aryl group (e.g., phenyl, 3,5-dichlorophenyl, o-methanesulfonamidophenyl, 4-methanesulfonylphenyl, and 2-hydroxymethylphenyl), and more preferably a hydrogen atom.

The group represented by $R_{12}$ may be substituted. Substituents applicable to $R_{12}$ include those enumerated above as the substituents of $R_{11}$.

In formula (IV), $G_{11}$ most preferably represents —CO—.

$R_{12}$ may be a group which makes the $G_{11}$—$R_{12}$ moiety split off from the remainder of formula (IV) to induce cyclization producing a cyclic structure containing the $G_{11}$—$R_{12}$ moiety. Suitable examples of the $R_{12}$ group are described, for example, in JP-A-63-29751.

$A_{11}$ and $A_{12}$ each particularly preferably represents a hydrogen atom.

$R_{11}$ or $R_{12}$ in formula (IV) may contain a ballast group commonly employed in immobile photographic additives such as couplers or may form a polymer. The ballast group is a group which contains at least 8 carbon atoms and is relatively ineffective with respect to photographic characteristics. Suitable examples of the ballast groups include an alkyl group, an alkoxy group, a phenyl group, an alkylphenyl group, a phenoxy group, and an alkylphenoxy group. Further, suitable examples of the polymers include those described in JP-A-1-100530.

$R_{11}$ or $R_{12}$ in formula (IV) may contain a group which accelerates adsorption onto surfaces of silver halide grains (hereinafter referred to as an adsorption accelerating group). Examples of such an adsorption accelerating group include a thiourea group, a heterocyclic thioamide group, a mercapto heterocyclic group, and a triazole group as described, for example, in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

Specific examples of the hydrazine compound represented by formula (IV) are set forth below, but the present invention should not be construed as being limited thereto:

(4-1)

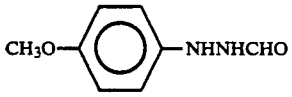

(4-2)

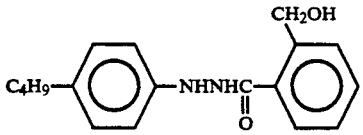

(4-3)

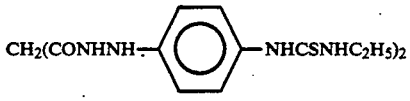

(4-4)

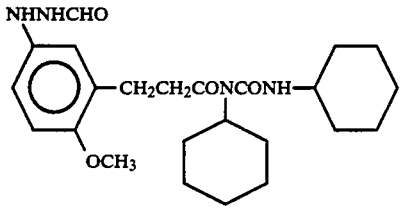

-continued
(4-5)
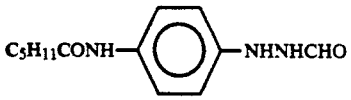
(4-6)
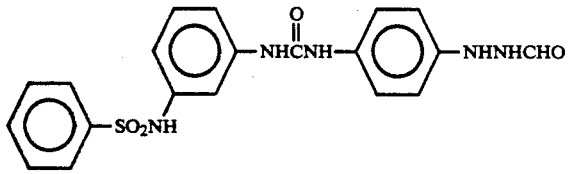
(4-7)
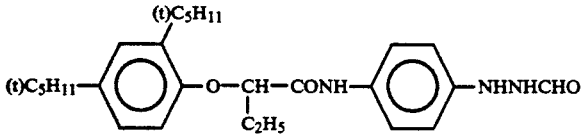
(4-8)
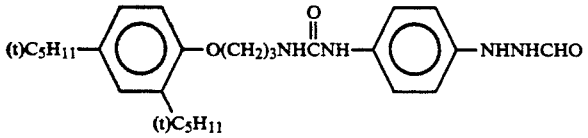
(4-9)
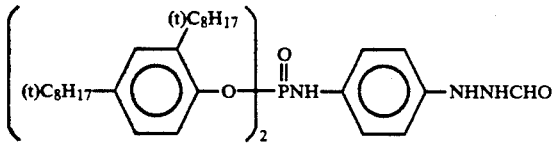
(4-10)
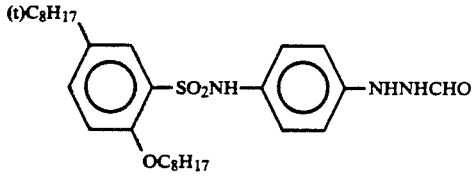
(4-11)
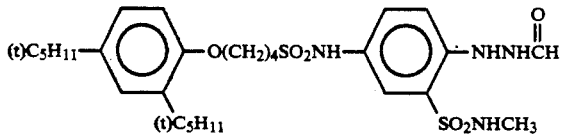
(4-12)
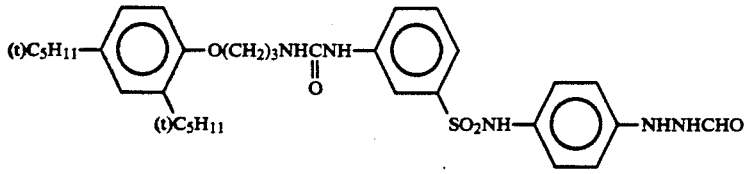
(4-13)
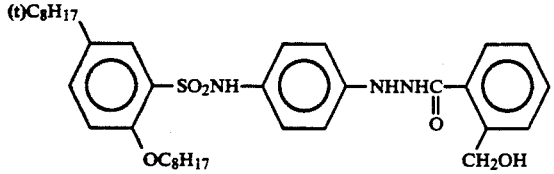

-continued
(4-14)
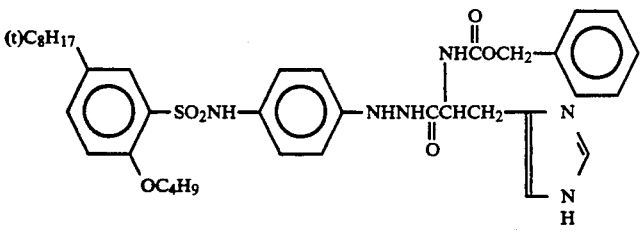
(4-15)
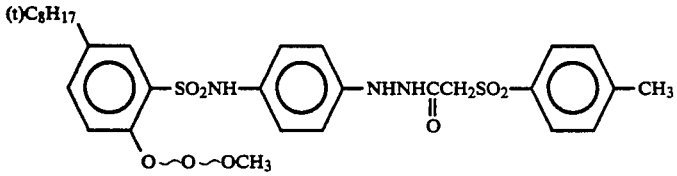
(4-16)
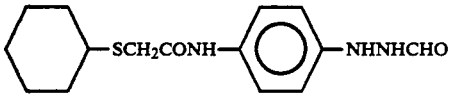
(4-17)
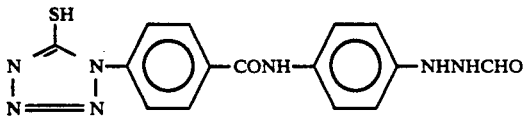
(4-18)
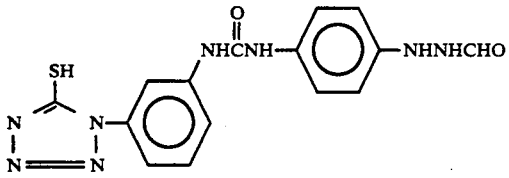
(4-19)
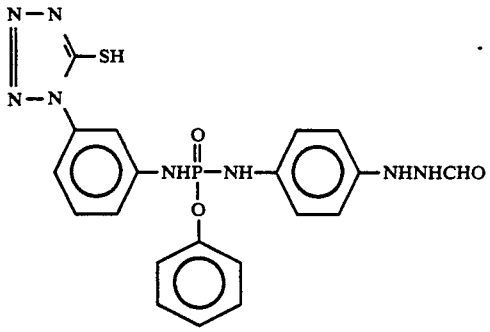
(4-20)
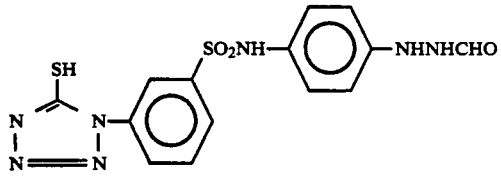
(4-21)
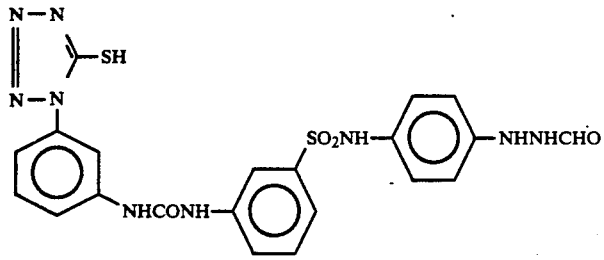

-continued (4-22)

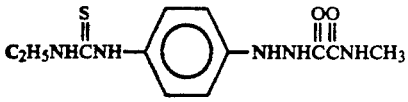

(4-23)

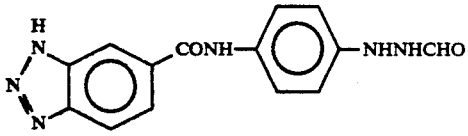

(4-24)

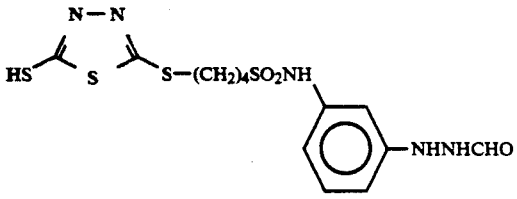

(4-25)

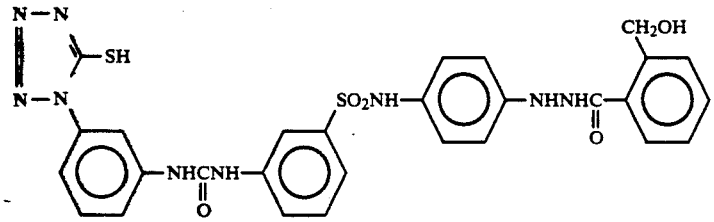

(4-26)

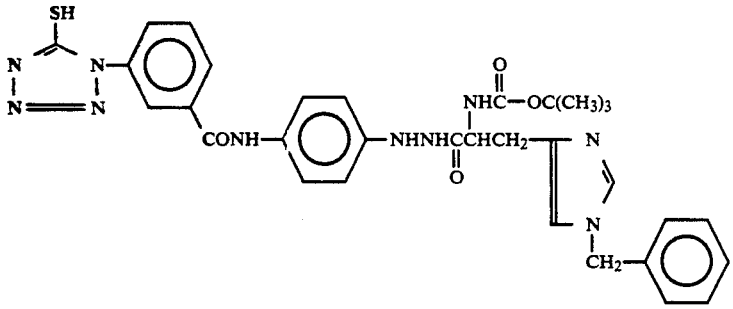

(4-27)

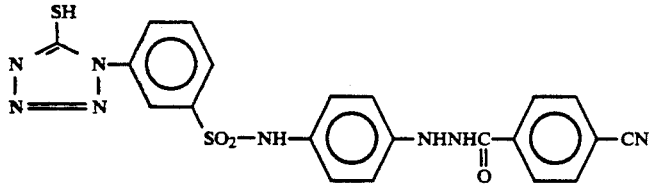

In addition to the above, it is also possible to use, as the hydrazine compounds used for the nucleating agents in the present invention, those described in *Research Disclosure*, No. 23516 (November, 1983), page 346, and those described in U.S. Pat. Nos. 4,080,207, 4,269,929, 4,276,364, 4,278,748, 4,385,108, 4,459,347, 4,560,638 and 4,478,928, British Patent 2,011,391B, JP-A-62-270948, JP-A-63-29751, JP-A-61-170733, JP-A-61-270744, JP-A-62-270948, European Patents 217,310 and 356,898, U.S. Patent 4,686,167, JP-A-62-178246, JP-A-63-32538, JP-A-63-104047, JP-A-63-121838, JP-A-63 129337, JP-A-63-223744, JP-A-63-234244, JP-A-63-234245, JP-A-63-234246, JP-A-63-294552, JP-A-63-306438, JP-A-1 100530, JP-A-1 105941, JP-A-1-105943, JP-A-64-10233, JP-A-1-90439, JP-A-1-276128, JP-A-1-280747, JP-A-1-283548, JP A-1-283549, JP-A-1-285940, JP-A-2-2541, JP-A-2-139538, JP-A-2-77057, JP-A-2-198440, JP-A-2-198441, JP-A-2-198442, JP-A-2-196234, JP-A-2-196235, JP-A-2-220042, JP-A-2-221953, JP-A-2-221954, JP-A-2-302750 and JP A-2 304550, and in the references cited therein.

The amount of the hydrazine compound employed as a nucleating agent in the present invention is preferably from $1\times10^{-6}$ to $5\times10^{-2}$ mol, and particularly preferably from $1\times10^{-5}$ to $2\times10^{-2}$ mol, per mol of silver halide.

As methods for dissolution and dispersion of the hydrazine nucleating agent, those described for the compound represented by formula (I) above can be employed.

The silver halide emulsions used in the present invention may be of any composition, such as silver chloride, silver bromide, silver chlorobromide, silver iodobromide or silver iodochlorobromide, for example.

The average grain size of the silver halide used in the present invention is preferably very fine (for example, not more than 0.7 μ), and a grain size of not more than 0.5 μ is most desirable. Fundamentally, no limitation is imposed upon the grain size distribution, but the use of a mono-dispersion is preferred. Here, the term "mono-dispersion" signifies that the emulsion is comprised of grains such that at least 95% of the grains in terms of the number of grains or by weight are of a size within ±40% of the average grain size.

The silver halide grains in the photographic emulsion may have a regular crystalline form such as a cubic or octahedral form, or they may have an irregular form such as a spherical or plate-like form, or they may have a form which is a composite of these forms.

The silver halide grains may be such that the interior and surface layer are comprised of a uniform phase, or the interior and surface layer may be comprised of different phases. Use can also be made of mixtures of two or more types of silver halide emulsions which have been prepared separately.

Cadmium salts, sulfites, lead salts, thallium salts, rhodium salts or complex salts thereof, and iridium salts or complex salts thereof, may also be present during the formation or physical ripening processes of the silver halide grains in the silver halide emulsions used in the present invention.

Water soluble dyes may be included in the emulsion layers or other hydrophilic colloid layers in the present invention as filter dyes, for the prevention of irradiation, or for various other purposes. Dyes for further reducing photographic speed, and preferably ultraviolet light absorbers which have a maximum spectral absorption peak in the intrinsically sensitive region of silver halides and dyes which essentially absorb light principally within the 350 nm to 600 nm range for increasing stability with respect to safelight when light-sensitive materials are handled as bright room-type light-sensitive materials, can be used as filter dyes.

These dyes may be added to the emulsion layer or they may be added together with a mordant to a light-insensitive hydrophilic colloid layer above the silver halide emulsion layer (i.e., which is further from the support than the silver halide emulsion layer) and fixed in this layer, depending on the intended purpose of the dye.

The amount of dye added differs depending on the molecular extinction coefficient thereof, but it is normally from $1\times10^{-2}$ g/m$^2$ to 1 g/m$^2$, and preferably from 50 mg/m$^2$ to 500 mg/m$^2$.

Specific examples of such dyes are described in detail in JP-A-63-64039.

The above described dyes are dissolved in a suitable solvent (for example, water, an alcohol (for example, methanol, ethanol, or propanol), acetone or methylcellosolve, or a mixture of such solvents) and added to the coating solution which is used for a light-insensitive hydrophilic colloid layer in the present invention.

Two or more of these dyes may be employed in a combination thereof.

The dye is employed in an amount necessary to make possible light-sensitive material handling in a bright room. More specifically, the amount of dye used is preferably from $1\times10^{-3}$ g/m$^2$ to 1 g/m$^2$, particularly preferably from $1\times10^{-3}$ g/m$^2$ to 0.5 g/m$^2$.

Gelatin is advantageously employed as a binder or a protective colloid in photographic emulsions. Other hydrophilic colloids may also be used. Examples of appropriate hydrophilic colloids include proteins, e.g., gelatin derivatives, graft polymers of gelatin with other polymers, albumin, and casein; cellulose derivatives, e.g., hydroxyethyl cellulose, carboxymethyl cellulose, and cellulose sulfate; sugar derivatives, e.g., sodium alginate, and starch derivatives; and a wide variety of synthetic hydrophilic high-molecular substances, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, and copolymers comprising monomers constituting these homopolymers.

The gelatin used includes not only lime-processed gelatin but acid-processed gelatin, hydrolysis products of gelatin, and enzymatic decomposition products of gelatin.

The silver halide emulsion used in the present invention may or may not be subjected to chemical sensitization. Sulfur sensitization, reduction sensitization and noble metal sensitization are known as methods for chemical sensitization of silver halide emulsions. Chemical sensitization can be carried out by these methods, either individually or in combination.

Gold sensitization among the noble metal sensitization methods is typical, and gold compounds, mainly gold complex salts, are used in this case. Complex salts of noble metals other than gold, for example of platinum, palladium or iridium, can also be included. Specific examples thereof are described, for example, in U.S. Pat. No. 2,448,060 and British Patent 618,061.

In addition to the sulfur compounds which are contained in gelatin, various sulfur compounds, for example, thiosulfates, thioureas, thiazoles, and rhodanines can be used as sulfur sensitizing agents.

Stannous salts, amines, formamidinsulfinic acid and silane compounds, for example, can be used as reduction sensitizing agents.

Known spectral sensitizing dyes may be added to the silver halide emulsion layer which can be used in the present invention.

Various compounds can be incorporated into the photographic materials of the present invention to prevent the occurrence of fog during the manufacture, storage or photographic processing of the light-sensitive material, or to stabilize photographic properties. Thus, many compounds which are known as anti-fogging agents or stabilizers, such as azoles (for example, benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, or nitrobenzotriazoles); mercaptopyrimidines; mercaptotriazines; thioketo compounds such as oxazolinethione; azaindenes (for example, triazaindenes, tetraazaindenes (especially 4-hydroxy substituted 1,3,3a,7-tetraazaindenes) and pentaazaindenes); benzenethiosulfonic acid; benzenesulfinic acid; and benzenesulfonic acid amide, can be used. Among these compounds, the benzotriazoles (for example, 5-methylbenzotriazole) and nitroindazoles (for example, 5-nitroindazole) are preferred. Furthermore, these compounds may be included in a processing solution.

Inorganic or organic hardening agents can be incorporated into the photographic emulsion layer or other hydrophilic colloid layers in the light-sensitive materials of the present invention. For example, chromium salts (for example, chromium alum), aldehydes (for example, glutaraldehyde), N-methylol compounds (for example, dimethylolurea), dioxane derivatives, active vinyl compounds (for example, 1,3,5-triacryloylhexahydro-s-triazine, or 1,3-vinylsulfonyl-2-propanol), active halogen compounds (for example, 2,4-dichloro-6-hydroxy-s-triazine), and mucohalogen acids can be used either individually or in combination.

A variety of surfactants can be included in the photographic emulsion layer or other hydrophilic colloid layers of the photographic material of the present invention, for various purposes, for example, as coating aids, as antistatic agents, for improving slipping properties, for emulsification and dispersion purposes, for the prevention of adhesions and for improving photographic performance (for example, accelerating development, increasing contrast or increasing speed).

For example, non-ionic surfactants, such as saponin (steroid based), alkylene oxide derivatives (for example, polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkyl amines or amides, and polyethylene oxide adducts of silicones), glycidol derivatives (for example, alkenylsuccinic acid polyglyceride, and alkylphenol polyglyceride), fatty acid esters of polyhydric alcohols, and sugar alkyl esters; anionic surfactants which include acidic groups, such as carboxy groups, sulfo groups, phospho groups, sulfate groups and phosphate groups (for example, alkylcarboxylates, alkylsulfonates, alkylbenzenesulfonates, alkylnaphthalenesulfonates, alkylsulfate, alkylphosphate, N-acyl-N-alkyltaurines, sulfosuccinate, sulfoalkylpolyoxyethylene alkylphenyl ethers, and polyoxyethylene alkylphosphate); amphoteric surfactants, such as amino acids, aminoalkylsulfonic acid, aminoalkyl sulfate or phosphate, alkylbetaines, and amineoxides; and cationic surfactants, such as alkylamine salts, aliphatic and aromatic quaternary ammonium salts, heterocyclic quaternary ammonium salts (for example, pyridinium salts and imidazolium salts), and phosphonium salts and sulfonium salts which contain aliphatic or heterocyclic rings can be employed.

The polyalkylene oxides having a molecular weight of at least 600 described in JP-B-58-9412 (the term "JP-B" as used herein means an "examined Japanese patent publication") are especially desirable surfactants for use in the present invention. Furthermore, polymer latexes, such as polyalkyl acrylate latexes, can be included for the purpose of providing dimensional stability.

In addition to the compounds described, for example, in JP-A-53-77616, JP-A-54-37732, JP-A-53-137133, JP-A-60-140340 and JP-A-60-14959, various compounds which contain a nitrogen or sulfur atom are effective as development accelerators or nucleation infectious development accelerators which are suitable for use in the present invention.

The appropriate amount of the development accelerator differs depending on the type of compound, but it is usually added in an amount of from $1.0\times10^{-3}$ g/m$^2$ to 0.5 g/m$^2$, and preferably from $5.0\times10^{-3}$ g/m$^2$ to 0.1 g/m$^2$. The accelerator is dissolved in a suitable solvent (for example, water, an alcohol such as methanol and ethanol, acetone, dimethylformamide, or methyl cellosolve) and added to the coating solution.

A plurality of these additives can be used conjointly.

A stable developing solution can be used to obtain ultrahigh contrast photographic characteristics using the silver halide photographic material of the present invention. There is no need for the use of conventional infectious developing solutions or highly alkaline developing solutions of a pH of nearly 13 as described in U.S. Pat. No. 2,419,975.

That is to say, ultrahigh contrast negative images can be obtained satisfactorily with the silver halide photographic material according to the present invention using a developing solution of pH 9.0 to 12.3, and preferably of pH 10.5 to 12.0, which contains at least 0.10 mol/liter of sulfite ion as a preservative.

No particular limitation is imposed upon the developing agent which can be used in the method of the present invention. Various compounds described in T. H. James, *The Theory of the Photographic Process*, Fourth Edition, pages 298 to 327 (Macmillan Co.) can be employed. For example, dihydroxybenzenes (for example, hydroquinone), 3-pyrazolidones (for example, 1-phenyl-3-pyrazolidone, or 4,4-dimethyl-1-phenyl-3-pyrazolidone), aminophenols (for example, N-methyl-p-aminophenol), ascorbic acid, and hydroxylamines can be employed either individually or in combination.

The silver halide photographic material of the present invention is especially suitable for processing in a developing solution which contains a dihydroxybenzene as a main developing agent and a 3-pyrazolidone or an aminophenol as an auxiliary developing agent. The combined use of from 0.05 to 0.5 mol/liter of a dihydroxybenzene and not more than 0.06 mol/liter of a 3-pyrazolidone or aminophenol in the developing solution is preferred.

Furthermore, the developing speed can be increased and the developing time can be shortened by adding amines to the developing solution, as described in U.S. Pat. No. 4,269,929.

Moreover, the developing solution may contain pH buffers, such as alkali metal sulfites, carbonates, borates and phosphates, and development inhibitors or antifoggants, such as bromides, iodides and organic antifoggants (nitroindazoles and benzotriazoles being especially preferred) can also be included in the developing solution. Hard water softening agents, dissolution aids, toning agents, development accelerators, surfactants (the above described polyalkylene oxides being especially preferred), defoaming agents, hardening agents, and agents for preventing silver contamination of film (for example, 2-mercaptobenzimidazolesulfonic acid) may be included in the developing solution, if desired.

Conventional compositions can be used for the fixing solution. In addition to thiosulfates and thiocyanates, the organosulfur compounds which are known to be effective as fixing agents can be used as fixing agents. Water soluble aluminum salts may be included in the fixing solution as hardening agents.

The processing temperature in the method of the present invention is normally selected in a range of from 18° C. to 50° C.

The use of an automatic processor is preferred for photographic processing, and ultrahigh contrast negative gradation photographic characteristics can be obtained satisfactorily with the method of the present invention, even if the total processing time from the introduction of the light-sensitive material into the processor to removal of the material from the processor is from 90 to 120 seconds.

The compounds described in JP-A-56-24347 can be used in the developing solution used in the present invention as agents for preventing silver contamination. The compounds described in JP-A-61-267759 can be used as dissolution aids which are added to the developing solution. Moreover, the compounds described in JP-A-60-3433 can be used as pH buffers in the developing solution.

Where the light-sensitive material according to the present invention is a color light-sensitive material, it may have at least one of a blue-sensitive silver halide emulsion layer, a green-sensitive silver halide emulsion layer and a red-sensitive silver halide emulsion layer on a support. The number of silver halide emulsion layers and light-insensitive layers and the order thereof are not particularly restricted. One typical example is a silver halide photographic material comprising a support having thereon at least one light-sensitive layer composed of a plurality of silver halide emulsion layers which have substantially the same sensitivity but different speeds. The light-sensitive layer is a unit light-sensitive layer having a sensitivity to any of blue light, green light and red light. In a multilayer silver halide color photographic material, unit light-sensitive layers are generally provided in the order of a red sensitive layer, a green-sensitive layer and a blue-sensitive layer, from the support side on the support. The order of these layers can be varied depending on the purpose. Further, a layer structure may be used wherein between two layers having the same sensitivity is sandwiched a light-sensitive layer having a different spectral sensitivity.

Between the above described silver halide light-sensitive layers or as the uppermost layer or the undermost layer, various light-insensitive layers such as an intermediate layer can be provided.

Into such a intermediate layer, couplers and DIR compounds as described, for example, in JP-A-61-43748, JP-A-59-113438, JP-A-59-113440, JP-A-61-20037 and JP-A-61-20038 may be incorporated. Further, the intermediate layer may contain color mixing preventing agents which are conventionally employed.

The plurality of silver halide emulsion layers which constitute the unit light-sensitive layer preferably have a two layer construction comprising a high speed emulsion layer and a low speed emulsion layer as described, for example, in West German Patent 1,121,470 and British Patent 923,045. It is preferred that these layers be disposed in order of increasing speed from the support side. Further, a light-insensitive layer may be provided between the silver halide emulsion layers. Moreover, a low speed emulsion layer may be provided further away from the support and a high speed emulsion layer may be provided on the side closest to the support as described, for example, in JP-A-57-112751, JP-A-62-200350, JP-A-62-206541 and JP-A 62-206543.

Specific examples of the layer construction include an order of a low speed blue-sensitive layer (BL)/a high speed blue-sensitive layer (BH)/a high speed green-sensitive layer (GH)/a low speed green-sensitive layer (GL)/a high speed red-sensitive layer (RH)/a low speed red-sensitive layer (RL) from the farthest from the support, an order of BH/BL/GL/GH/RH/RL, or an order of BH/BL/GH/GL/RL/RH.

Further, the order of a blue-sensitive layer/GH/RH/GL/RL from the farthest from the support as described in JP-B-55-34932 may be employed. Moreover, an order of a blue-sensitive layer/GL/RL/GH/RH from the farthest from the support as described in JP-A-56-25738 and JP-A-62-63936 may also employed.

Furthermore, a layer construction of three layers having different speeds comprising an upper silver halide emulsion layer having the highest speed, an intermediate silver halide emulsion layer having a lower speed than that of the upper layer, and an under silver halide emulsion layer having a lower speed than that of the intermediate layer in order of increasing speed from the support as described in JP-B-49-15495 is also employed. When the unit light-sensitive layer of the same sensitivity is composed of three layers having different speeds, an order of an intermediate speed emulsion layer/a high speed emulsion layer/a low speed emulsion layer from the farthest from the support may be employed as described in JP-A-59-202464.

In addition, the order of a high speed emulsion layer/a low speed emulsion layer/an intermediate speed emulsion layer, or the order of a low speed emulsion layer/an intermediate speed emulsion layer/a high speed emulsion layer, may be employed.

In case of four layers or more, the order can be varied as described above.

In order to improve color reproducibility, it is preferred that a donor layer (CL) of interlayer effect having a spectral sensitivity distribution different from that of the main light-sensitive layer such as BL, GL or RL is provided adjacent or close to the main layer as described, for example, in U.S. Pat. Nos. 4,663,271, 4,705,744 and 4,707,436, JP-A-62-160448 and JP-A-63-89850.

As described above, various layer constructions and dispositions may be appropriately selected depending on the purpose of the light-sensitive material.

When the light-sensitive material of the present invention is a color negative film or a color reversal film, the silver halide preferably employed in the photographic emulsion layers thereof is silver iodobromide, silver iodochloride or silver iodochlorobromide each containing about 30 mol% or less of silver iodide. Silver iodobromide and silver iodochlorobromide each containing from about 2 mol% to about 25 mol% of silver iodide are particularly preferred.

When the light-sensitive material of the present invention is a color printing paper, the silver halide preferably employed in the photographic emulsion layers thereof is silver chlorobromide or silver chloride each containing substantially no silver iodide. The terminology "containing substantially no silver iodide" as used herein means that the silver iodide content of the emulsion is generally not more than 1 mol%, preferably not more than 0.2 mol%, based on the total silver halide content.

With respect to the halogen composition of a silver chlorobromide emulsion, any silver bromide/silver chloride ratio may be employed. The ratio may be widely varied depending on the purpose, but emulsions having a silver chloride content ratio of 2 mol% or more are preferably employed, based on the total silver halide content.

In light-sensitive materials suitable for rapid processing, a so called high silver chloride content emulsion which has a high silver chloride content ratio is preferably used. The silver chloride content ratio in such a high silver chloride content emulsion is preferably 90 mol% or more, more preferably 95 mol% or more, based on the total silver halide content.

Further, for the purpose of reducing the amount of replenisher for the developing solution, an almost pure silver chloride emulsion such as one wherein a silver chloride content is from 98 mol% to 99.9 mol% is preferably employed, based on the total silver halide content.

Silver halide grains in the silver halide emulsion may have a regular crystal structure, for example, a cubic, octahedral or tetradecahedral structure, an irregular crystal structure, for example, a spherical or plate-like structure, a crystal defect, for example, a twin plane, or a composite structure thereof.

The particle size of silver halide may be varied and include from fine grains having about 0.2 micron or less to large size grains having about 10 microns as a diameter of projected area. Further, a polydispersed emulsion and a monodispersed emulsion may be used.

The silver halide photographic emulsion which can be used in the present invention can be prepared using known methods, for example, those as described in *Research Disclosure,* No. 17643 (December, 1978), pages 22 to 23, "I. Emulsion Preparation and Types" and ibid., No. 18716 (November, 1979), page 648, P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964).

Monodispersed emulsions as described, for example, in U.S. Pat. Nos. 3,574,628 and 3,655,394, and British Patent 1,413,748 are preferably used in the present invention.

Further, tabular silver halide grains having an aspect ratio of about 5 or more can be employed in the present invention. The tabular grains may be easily prepared by the method as described, for example, in Gutoff, *Photographic Science and Engineering,* Vol. 14, pages 248 to 257 (1970), U.S. Pat. Nos. 4,434,226, 4,414,310, 4,433,048 and 4,439,520, and British Patent 2,112,157.

The crystal structure of the silver halide grains may be uniform, composed of different halide compositions between the inner portion and the outer portion, or may be stratified.

Further, silver halide emulsions in which silver halide grains having different compositions are connected at epitaxial junctions or silver halide emulsions in which silver halide grains are connected with compounds other than silver halide, such as silver thiocyanate, or lead oxide, may also be employed.

Moreover, a mixture of grains having a different crystal structure may be used.

The silver halide emulsions used in the present invention are usually subjected to physical ripening, chemical ripening and spectral sensitization. Various kinds of additives which can be employed in these steps are described in *Research Disclosure,* No. 17643, (December, 1978) and ibid., No. 18716 (November, 1979) and concerned items thereof are summarized in the table shown below.

In the present invention, it is preferred to employ light-insensitive fine grain silver halide. The terminology "light-insensitive fine grain silver halide" means silver halide fine grains which are not sensitive to light at the time of imagewise exposure for obtaining dye images and are not substantially developed at the time of development processing. These silver halide fine grains are preferably those previously not fogged.

The fine grain silver halide has a silver bromide content of from 0 to 100 mol%, and may contain silver chloride and/or silver iodide, if desired. Preferred silver halides are those containing from 0.5 to 10 mol% of silver iodide.

The fine grain silver halide has preferably an average grain size (the average value of the diameter corresponding to the circle of the projected area) of from 0.01 to 0.5 μm, more preferably from 0.02 to 0.2 μm.

The fine grain silver halide can be prepared by the same methods as those used for conventional light-sensitive silver halide. The surface of silver halide grain is not necessarily optically sensitized. Spectral sensitization is also not needed. However, it is preferred to add beforehand a known stabilizer (for example, a triazole compound, an azaindene compound, a benzothiazolium compound, a mercapto compound, or a zinc compound) to the fine grain silver halide before it is added to the coating solution.

Further, known photographic additives which can be used in the present invention are also described in the above mentioned literature references and specific items therein are summarized in the table below.

| Kind of Additives | RD 17643 | RD 18716 |
|---|---|---|
| 1. Chemical Sensitizers | Page 23 | Page 648, right column |
| 2. Sensitivity Increasing Agents | — | Page 648, right column |
| 3. Spectral Sensitizers and Supersensitizers | Pages 23 to 24 | Page 648, right column to page 649, right column |
| 4. Brightening Agents | Page 24 | — |
| 5. Antifoggants and Stabilizers | Pages 24 to 25 | Page 649, right column |
| 6. Light-Absorbers, Filter Dyes and Ultraviolet Ray Absorbers | Pages 25 to 26 | Page 649, right column to page 650, left column |
| 7. Antistaining Agents | Page 25, right column | Page 650, left column to right column |
| 8. Dye Image Stabilizers | Page 25 | — |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surfactants | Pages 26 to 27 | Page 650, right column |
| 13. Antistatic Agents | Page 27 | Page 650, right column |

Further, in order to prevent degradation of photographic properties due to formaldehyde gas, it is preferred to add a compound capable of reacting with formaldehyde to fix it, as described in U.S. Pat. Nos. 4,411,987 and 4,435,503, to the light-sensitive material.

In the present invention, various color couplers can be employed and specific examples thereof are described in the patents cited in *Research Disclosure,* No. 17643, "VII-C" to "VII G".

The preferred yellow couplers used in the present invention include, for example, those described in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent 249,473A.

The preferred magenta couplers used in the present invention are 5-pyrazolone type and pyrazoloazole type compounds. Magenta couplers described, for example, in U.S. Pat. Nos. 4,310,619 and 4,351,897, European Patent 73,636, U.S. Pat. Nos. 3,061,432 and 3,725,067, *Research Disclosure,* No. 24220 (June, 1984), JP-A-60-33552, *Research Disclosure,* No. 24230 (June, 1984), JP-A-60-43659, JP-A-61-72238, JP-A-60-35730, JP-A-55-118034, JP-A-60-185951, and U.S. Pat. Nos. 4,500,630, 4,540,654 and 4,556,630, and WO(PCT) 88/04795, are particularly preferred.

The cyan couplers used in the present invention include phenol type and naphthol type couplers. Cyan couplers described, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Patents 121,365A and 249,453A, U.S. Patents 3,446,622, 4,333,999, 4,775,616, 4,451,559, 4,427,767, 4,690,889, 4,254,212 and 4,296,199, and JP-A-61-42658, are preferred.

The preferred colored couplers for correcting undesirable absorption of dyes formed are described, for example, in *Research Disclosure,* No. 17643, "VII-G", U.S. Pat. No. 4,163,670, JP-B-57-39413, U.S. Pat. Nos. 4,004,929 and 4,138,258, and British Patent 1,146,368. It is also preferred to use couplers for correcting undesirable absorption of dyes formed by a fluorescent dye released upon coupling described, for example, in U.S. Pat. No. 4,774,181, or couplers having a dye precursor group capable of forming a dye upon a reaction with a developing agent, as a releasing group, described, for example, in U.S. Pat. No. 4,777,120.

The preferred couplers capable of forming appropriately diffusible dyes are those described, for example, in U.S. Pat. No. 4,366,237, British Patent 2,125,570, European Patent 96,570, and West German Patent Application (OLS) No. 3,234,533.

Typical examples of polymerized dye forming couplers are described, for example, in U.S. Pat. Nos. 3,451,820, 4,080,211, 4,367,282, 4,409,320 and 4,576,910, and British Patent 2,102,137.

Couplers capable of releasing a photographically useful moiety during the course of coupling can be also employed preferably in the present invention. As DIR couplers capable of releasing a development inhibitor, those as described, for example, in the patents cited in *Research Disclosure,* No. 17643, "VII-F" described above, JP-A-57-151944, JP-A-57-154234, JP-A-60-184248, JP-A-63-37346, JP-A-63-37350, and U.S. Pat. Nos. 4,248,962 and 4,782,012 are preferred.

The preferred couplers which release imagewise a nucleating agent or a development accelerator at the time of development are those described, for example, in British Patents 2,097,140 and 2,131,188, JP-A-59-157638, and JP-A-59-170840.

Furthermore, competing couplers such as those described, for example, in U.S. Pat. No. 4,130,427; polyequivalent couplers such as those described, for example, in U.S. Pat. Nos. 4,283,472, 4,338,393 and 4,310,618; DIR redox compound or DIR coupler releasing couplers or DIR coupler or DIR redox compound releasing redox compounds such as those described, for example, in JP-A-60-185950 and JP-A-62-24252; couplers capable of releasing a dye which is color restored after being released such as those described, for example, in European Patents 173,302A and 313,308A; bleach accelerator releasing couplers such as those described, for example, in *Research Disclosure,* No. 11449, ibid, No. 24241 and JP-A-61-201247; ligand releasing couplers such as those described, for example, in U.S. Pat. No. 4,555,477; couplers capable of releasing a leuco dye such as those described, for example, in JP-A-63-75747; and couplers capable of releasing a fluorescent dye such as those described, for example, in U.S. Pat. No. 4,774,181, may be employed in the light-sensitive material of the present invention.

The couplers which can be used in the present invention can be introduced into the light-sensitive material according to various known dispersing methods.

Suitable examples of organic solvents having a high boiling point which can be employed in an oil droplet-in-water type dispersing method are described, for example, in U.S. Pat. No. 2,322,027.

Specific examples of organic solvents having a high boiling point of not less than 175° C. at normal pressure and which can be employed in an oil drop-in-water type dispersion method include phthalic acid esters (for example, dibutyl phthalate, dicyclohexyl phthalate, di-2-ethylhexyl phthalate, decyl phthalate, bis(2,4-di-tert-amylphenyl)phthalate, bis(2,4-di-tertamylphenyl)isophthalate, or bis(1,1-diethylpropyl)phthalate, phosphonic acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, or di-2-ethylhexyl phenylphosphonate), benzoic acid esters (for example, 2-ethylhexyl benzoate, dodecyl benzoate, or 2-ethylhexyl-p-hydroxybenzoate), amides (for example, N,N-diethyldodecanamide, N,N-diethyllaurylamide, or N-tetradecylpyrrolidone), alcohols or phenols (for example, isostearyl alcohol, or 2,4-ditert-amylphenol), aliphatic carboxylic acid esters (for example, bis(2-ethylhexyl)-sebacate, dioctyl azelate, gycerol tributyrate, isostearyl lactate, or trioctyl citrate), aniline derivatives (for example, N,N-dibutyl-2-butoxy-5-tert-octylaniline), and hydrocarbons (for example, paraffin, dodecylbenzene, or diisopropylnaphthalene).

Further, an organic solvent having a boiling point of at least about 30° C. and preferably having a boiling point of above 50° C. but below about 160° C. can be used as an auxiliary solvent. Typical examples of auxiliary solvents include ethyl acetate, butyl acetate, ethyl propionate, methyl ethyl ketone, cyclohexanone, 2-ethoxyethyl acetate, or dimethylformamide.

The processes and effects of latex dispersing methods and specific examples of latexes for loading are described, for example, in U.S. Pat. No. 4,199,363 and West German Patent Application (OLS) Nos. 2,541,274 and 2,541,230.

Further, these couplers can be emulsified and dispersed in an aqueous solution of a hydrophilic colloid by loading them into a loadable latex polymer (such as those described in U.S. Pat. No. 4,203,716) in the presence of or in the absence of the above described organic solvent having a high boiling point, or by dissolving them in a water-insoluble and organic solvent-soluble polymer.

Suitable examples of these polymers include the homopolymers and copolymers described in International Laid Open No. WO 88/00723, pages 12 to 30. Particularly, acrylamide polymers are preferably used in view of their improved color image stability.

It is preferred to add various kinds of antiseptics or antimolds (for example, 1,2-benzisothiazolin-3-one, n-butyl-p-hydroxybenzoate, phenol, 4-chloro-3,5-dimethylphenol, 2-phenoxyethanol, or 2-(4-thiazolyl)-benzimidazole) as described, for example, in JP-A-63-

257747, JP-A-62-272248 and JP-A-1-80941, to the color light sensitive material of the present invention.

The present invention can be applied to various color light sensitive materials, and typical examples thereof include color negative films for the general use or cinematography, color reversal films for slides or television, color papers, color positive films, and color reversal papers.

Suitable supports which can be used in the present invention are described, for example, in *Research Disclosure,* No. 17643, page 28 and ibid., No. 18716, page 647, right column to page 648, left column, as mentioned above.

It is preferred that the total layer thickness of all the hydrophilic colloid layers provided on the emulsion layer side of the light-sensitive material according to the present invention is not more than 28 μm, more preferably not more than 23 μm, even more preferably not more than 18 μm, and particularly preferably not more than 16 μm. Also, a layer swelling rate of $T_{\frac{1}{2}}$ is preferably not more than 30 seconds, more preferably not more than 20 seconds. The layer thickness means the thickness of the layers measured after preservation under the conditions of 25° C. and relative humidity of 55% for 2 days. The layer swelling rate of $T_{\frac{1}{2}}$ is determined according to a known method in the field of the art. For instance, the degree of swelling can be measured using a swellometer of the type described in A. Green, *Photogr. Sci. Eng.,* Vol. 19, No. 2, page 124 to 129, and $T_{\frac{1}{2}}$ is defined as the time necessary for reaching a layer thickness of one half of the saturated layer thickness which is 90% of the maximum swelling layer thickness obtained when it is treated in a color developing solution at 30° C. for 3 minutes and 15 seconds.

The layer swelling rate of $T_{\frac{1}{2}}$ can be controlled by adding a hardening agent to a gelatin binder or changing the aging conditions after coating.

The rate of swelling is preferably from 150% to 400%. The rate of swelling factor can be calculated by the formula of (maximum swelling layer thickness—layer thickness)/layer thickness, wherein the maximum swelling layer thickness has the same meaning as defined above.

The color light-sensitive material according to the present invention can be subjected to development processing in a conventional manner as described in *Research Disclosure,* No. 17643, pages 28 to 29 and ibid., No. 18716, page 651, left column to right column, as mentioned above.

The color developing solution which can be used in the development processing of the light-sensitive material according to the present invention is an alkaline aqueous solution preferably containing an aromatic primary amine type color developing agent as the main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-8-hydroxyethylaniline, 3-methyl-4-amino-N-ethyl N-8-methanesulfonamidoethylaniline, 3-methyl-4-amino-N-ethyl-8-methoxyethylaniline, or sulfate, hydrochloride or p-toluenesulfonate thereof. Among these compounds, 3-methyl-4-amino-N-ethyl-N-β-hydroxyethylaniline sulfate is particularly preferred.

Two or more kinds of color developing agents may be employed in a combination thereof, depending on the purpose.

The color developing solution can ordinarily contain pH buffering agents, such as carbonates, borates or phosphates of alkali metals; and development inhibitors or anti-fogging agents such as chlorides, bromides, iodides, benzimidazoles, benzothiazoles, or mercapto compounds. Further, if desired, the color developing solution may contain various preservatives, for example, hydroxylamine, diethylhydroxylamine, sulfites, hydrazines such as N,N-biscarboxymethylhydrazine, phenylsemicarbazides, triethanolamine, or catechol sulfonic acids; organic solvents such as ethyleneglycol, or diethylene glycol; development accelerators such as benzyl alcohol, polyethylene glycol, quaternary ammonium salts, or amines; dye forming couplers; competing couplers; auxiliary developing agents such as 1-phenyl-3-pyrazolidone; viscosity imparting agents; and various chelating agents representatively illustrated by aminopolycarboxylic acids, aminopolyphosphonic acids, alkylphosphonic acids, or phosphonocarboxylic acids. Representative examples of the chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1 diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and salts thereof.

In case of conducting reversal processing, color development is usually conducted after black-and-white development. In a black-and-white developing solution, known black-and-white developing agents, for example, dihydroxybenzenes such as hydroquinone, 3-pyrazolidones such as 1-phenyl-3-pyrazolidone, or aminophenols such as N-methyl p aminophenol, may be employed individually or in combination.

The pH of the color developing solution or the black-and-white developing solution is usually in the range from 9 to 12. Further, the amount of the replenisher for the developing solution can be varied depending on the color light-sensitive materials to be processed, but it is generally not more than 3 liters per square meter of the light-sensitive material. The amount of the replenisher can be reduced to not more than 500 ml by decreasing the bromide ion concentration in the replenisher. In the case of reducing the amount of the replenisher, it is preferred to prevent evaporation and aerial oxidation of the processing solution by reducing the area of the processing tank which is in contact with the air.

The contact area of a photographic processing solution with the air in the processing tank can be represented by an opening rate as defined below:

$$\text{Opening Rate} = \frac{\text{Contact area of processing solution with the air (cm}^2\text{)}}{\text{Volume of processing solution (cm}^3\text{)}}$$

The opening rate described above is preferably not more than 0.1, more preferably from 0.001 to 0.05. Means for reducing the opening rate include a method using a movable cover as described in JP-A-1-82033, a slit development processing method as described in JP-A-63-216050, in addition to a method wherein a shelter such as a floating cover is provided on the surface of the photographic processing solution in the processing tank. It is preferred to apply the reduction of the opening rate not only to the steps of color development and black-and-white development but also to all other subsequent steps, for example, bleaching, bleach-fixing, fixing, washing with water and stabilizing.

Further, the amount of replenisher can be reduced using a means which restrains accumulation of bromide ion in the developing solution.

The processing time for color development is usually selected in a range from 2 minutes to 5 minutes. However, it is possible to conduct further reduction of the processing time by performing color development at high temperature and high pH using a high concentration of color developing agent.

After color development, the photographic emulsion layers are usually subjected to a bleach processing. The bleach processing can be performed simultaneously with a fix processing (bleach-fix processing), or it can be performed independently from the fix processing. Further, for the purpose of rapid processing, a processing method wherein, after a bleach processing, a bleach-fix processing is conducted, may be employed. Moreover, it may be appropriate, depending on the purpose, to process using a continuous two tank bleach-fixing bath, to fix process before bleach-fix processing, or to conduct bleach processing after bleach-fix processing.

Examples of bleaching agents which can be employed in the bleach processing or bleach-fix processing include compounds of a multivalent metal such as iron(III); peracids; quinones; or nitro compounds. Representative examples of the bleaching agents include organic complex salts of iron(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, or glycol ether diaminetetraacetic acid), or complex salts of organic acids (such as citric acid, tartaric acid, or malic acid). Of these compounds, iron(III) complex salts of aminopolycarboxylic acids representatively illustrated by iron(III) complex salt of ethylenediaminetetraacetic acid and iron(III) complex salt of 1,3-diaminopropanetetraacetic acid are preferred to conduct rapid processing with less environmental pollution. Furthermore, iron(III) complex salts of aminopolycarboxylic acids are particularly useful in both bleaching solutions and bleach-fixing solutions.

The pH of the bleaching solution or bleach-fixing solution containing an iron(III) complex salt of aminopolycarboxylic acid is usually in the range from 4.0 to 8. For the purpose of performing rapid processing, it is possible to process at a pH lower than the above described range.

In the bleaching solution, the bleach-fixing solution or a prebath thereof, a bleach accelerating agent can be used, if desired. Specific examples of suitable bleach accelerating agents include compounds having a mercapto group or a disulfide group described, for example, in U.S. Pat. No. 3,893,858, West German Patents 1,290,812 and 2,059,988, JP-A-53-32736, JP-A-53-37831, JP-A-53-37418, JP-A 53 72623 JP-A-53-95630 JP-A-53-95631, JP-A-53-104232, JP-A-53-124424, JP-A-53-141623, JP-A-53-28426, and *Research Disclosure*, No. 17129 (July 1978); thiazolidine derivatives described, for example, in JP-A-50 140129; thiourea derivatives described, for example, in JP-B-45-8506, JP-A-52-20832, JP-A-53 32735 and U.S. Pat. No. 3,706,561; iodides described, for example, in West German Patent 1,127,715 and JP-A-58-16235; polyoxyethylene compounds described, for example, in West German Patents 966,410 and 2,748,430; polyamine compounds described, for example, in JP-B-45-8836; compounds described, for example, in JP-A-49-40943, JP-A-49-59644, JP-A-53-94927, JP A-54-35727, JP-A-55-26506, and JP-A-58-163940; and bromide ions. Of these compounds, the compounds having a mercapto group or a disulfide group are preferred in view of their high bleach accelerating effect. Particularly, the compounds described in U.S. Pat. No. 3,893,858, West German Patent 1,290,812 and JP-A 53-95630 are preferred. Further, the compounds described in U.S. Pat. No. 4,552,834 are also preferred. These bleach accelerating agents may be incorporated into the color light-sensitive material. These bleach accelerating agents are particularly effectively employed when color light sensitive materials for photographing are subjected to bleach-fix processing.

To the bleaching solution or bleach-fixing solution, an organic acid is preferably incorporated for the purpose of preventing bleach stain. Particularly preferred organic acids are compounds having an acid dissociation constant (pKa) of from 2 to 5 and include acetic acid and propionic acid.

The fixing agents which can be employed in the fixing solution or bleach-fixing solution are thiosulfates, thiocyanates, thioether compounds, thioureas, or a large amount of iodide. Of these compounds, thiosulfates are generally employed. Particularly, ammonium thiosulfate is most widely employed. Combinations of thiosulfates with either thiocyanates, thioether compounds or thioureas are also preferably employed. It is preferred to use sulfites, bisulfites, carbonylbisulfite adducts or sulfinic acid compounds as described in European Patent 294,769A as preservatives in the fixing solution or bleach-fixing solution. Moreover, it is preferred to add various aminopolycarboxylic acids and organic phosphonic acids to the fixing or bleach fixing solution for the purpose of stabilization of the solution.

A shorter total time of the desilvering step is preferable since failure of desilvering does not occur. Thus, the processing time for the desilvering step is preferably from 1 minute to 3 minutes, more preferably from 1 minute to 2 minutes. The processing temperature is generally from 25 to 50° C, preferably 35 to 45° C. In the preferred processing temperature range, the desilvering rate increases and the occurrence of stain after processing is effectively prevented.

In the desilvering step, it is preferred to perform stirring as vigorously as possible.

Specific examples of methods for strengthening stirring include a method wherein a jet of the processing solution strikes the emulsion surface of the light-sensitive material as described in JP-A-62-183460, a method for increasing the stirring effect using a rotating means as described in JP-A-62-183461, a method for increasing the stirring effect by transferring the light-sensitive material while bringing the emulsion surface thereof into contact with a wiper blade provided in the solution to form turbulent flow on the emulsion surface, and a method of increasing circulation flow of the total processing solution. These means for strengthening stirring are effective in the bleaching solution, the bleach-fixing solution or the fixing solution. It is believed that the strengthening of stirring promotes the supply with the bleaching agent and the fixing agent to the emulsion layer, resulting in an increase in the desilvering rate.

Further, the above-described means for strengthening stirring are more effective when using a bleach accelerating agent and remarkably increase its accelerating effect or eliminate the fixing hindrance function due to the bleach accelerating agent.

The automatic developing machine to be used for the processing of light-sensitive material in the present invention is preferably provided with a transportation means for the light-sensitive material as described in JP-A-60-191257, JP-A-60-191258 and JP-A-60-191259. As described in JP-A-60-191257, such a transportation means can greatly reduce the amount of processing solution carried over from the preceding bath to the after bath, and degradation of the processing solution is effectively prevented. Such an effect is particularly useful for the reduction of the processing time at each step and the reduction of the replenishment amount of the processing solution at each step.

After a desilvering step, the silver halide color photographic material according to the present invention is generally subjected to a water washing step and/or a stabilizing step.

The amount of water required for the water washing step may be set in a wide range depending on the characteristics of the light-sensitive materials (due to elements used therein, for example, couplers), the uses thereof, the temperature of the washing water, the number of water washing tanks (stages), the replenishment system such as countercurrent or cocurrent, or other various conditions. The relationship between the number of water washing tanks and the amount of water in a multi-stage countercurrent system can be determined based on the method described in *Journal of the Society of Motion Picture and Television Engineers,* Vol. 64, pages 248 to 253 (May, 1955).

According to the multi-stage countercurrent system described in the above literature references, the amount of water for washing can be significantly reduced. However, an increase in the staying time of water in a tank causes a propagation of bacteria, and some problems occur such as adhesion of floatage formed on the photographic materials. In the method of processing the silver halide color photographic material according to the present invention, a method for reducing the amount of calcium ions and magnesium ions as described in JP-A-62-288838 can be particularly effectively employed in order to solve such problems. Further, sterilizers, for example, isothiazolone compounds and cyabendazoles described in JP-A-57-8542, chlorine type sterilizers such as sodium chloroisocyanurate, benzotriazoles, sterilizers described in Hiroshi Horiguchi, *Bokin-Bobai No Kaqaku* (Sankyo Shuppan, 1986), *Biseibutsu No Mekkin-, Sakkin-, Bobai-Gijutsu,* edited by Eiseigijutsu Kai (1982), and *Bokin-Bobaizai Jiten,* edited by Nippon Bokin-Bobai Gakkai (1986), can be employed.

The pH of the washing water used in the processing of the light-sensitive materials according to the present invention is usually from 4 to 9, preferably from 5 to 8. The temperature of the washing water and time for the water washing step can be widely set depending on the characteristics or uses of the light-sensitive materials. However, it is normal to select a range of from 15° C. to 45° C. and a period from 20 sec. to 10 min. and preferably a range of from 25° C. to 40° C. and a period from 30 sec. to 5 min.

The light-sensitive material of the present invention can also be directly processed with a stabilizing solution in place of the above-described water washing step. In such a stabilizing process, any of the known methods described, for example, in JP-A-57-8543, JP-A-58-14834 and JP-A-60-220345, can be employed.

Further, it is possible to conduct the stabilizing process subsequent to the above-described water washing process. One example thereof is a stabilizing bath containing a dye stabilizer and a surface active agent, which is employed as a final bath in the processing of color light-sensitive materials for photographing. Examples of the dye stabilizers include aldehydes such as formaldehyde or glutaraldehyde, N-methylol compounds, hexamethylenetetramine, and aldehyde sulfite adducts. To such a stabilizing bath, various chelating agents and antimolds may also be added.

Overflow solutions resulting from replenishment of the above-described washing water and/or stabilizing solution may be reused in other steps such as in a desilvering step.

In the processing using an automatic developing machine, concentration of the processing solution at each step tends to occur by evaporation. In order to compensate for the concentration of processing solution, it is preferred to replenish with an appropriate amount of water.

For the purpose of simplification and acceleration of processing, a color developing agent may be incorporated into the silver halide color photographic material according to the present invention. In order to incorporate the color developing agent, it is preferred to employ various precursors of the color developing agents. Suitable examples of the precursors of developing agents include indoaniline type compounds described in U.S. Pat. No. 3,342,597, Schiff's base type compounds described in U.S. Pat. No. 3,342,599 and *Research Disclosure,* No. 14850 and ibid., No. 15159, aldol compounds described in *Research Disclosure,* No. 13924, metal salt complexes described in U.S. Pat. No. 3,719,492, and urethane type compounds described in JP-A-53-135628.

Further, the silver halide color photographic material according to the present invention may contain, if desired, various 1-phenyl-3-pyrazolidones for the purpose of accelerating color development. Typical examples of the compounds include those described, for example, in JP-A-56-64339, JP A 57-144547 and JP-A-58-15438.

In the present invention, the various processing solutions are used at a temperature of from 10° C. to 50° C. The standard temperature range is normally from 33° C. to 38° C. However, a higher temperature range can be used to accelerate processing, thereby reducing the processing time. On the contrary, a lower temperature range can be used to improve image quality or stability of the processing solutions.

The compound according to the present invention can be employed in heat-developable light-sensitive materials. Suitable examples of heat-developable light-sensitive materials are described, for example, in U.S. Pat. Nos. 4,463,079, 4,474,867, 4,478,927, 4,507,380, 4,500,626 and 4,483,914, JP-A-58-149046, JP-A-58-149047, JP-A-59 152440, JP-A-59-154445, JP-A-59-165054, JP-A-59-180548, JP-A-59-168439, JP-A-59-174832, JP-A-59-174833, JP A 59 174834, JP-A-59-174835, JP-A-61-232451, JP-A-62-65038, JP-A-62-253159, JP-A-63-316848, JP-A-64-13546, and European Patent Application (OPI) Nos. 210,660A2 and 220,746A2.

The present invention is now illustrated in greater detail with reference to the following examples, but the present invention is not to be construed as being limited thereto.

EXAMPLE 1

First Light-Sensitive Emulsion Layer

Preparation of Light-Sensitive Emulsion A

An aqueous solution containing 0.37 M of silver nitrate and an aqueous halide solution containing $1\times10^{-7}$ mol/mol-Ag of $(NH_4)_3RhCl_6$, $5\times10^{-7}$ mol/mol-Ag of $K_3IrCl_6$, 0.11 M of potassium bromide and 0.27 M of sodium chloride were added to an aqueous gelatin solution containing sodium chloride and 1,3-dimethyl-2-imidazolidinethione at 45° C. with stirring over a period of 12 minutes by a double jet process. Nucleation resulted, whereby silver chlorobromide grains having an average grain size of 0.20 μm and a silver chloride content of 70 mol% were obtained. Then, an aqueous solution containing 0.63 M of silver nitrate and an aqueous halide solution containing 0.19 M of potassium bromide and 0.47 M of sodium chloride were added thereto over a period of 20 minutes by a double jet process in the same manner as above. The resulting emulsion was subjected to conversion by adding an aqueous solution containing $1\times10^{-3}$ mol of potassium iodide, washed by a flocculation method in a conventional manner, and 40 g of gelatin was added thereto. After adjusting the pH to 6.5 and the pAg to 7.5, 5 mg/mol-Ag of sodium thiosulfate, 8 mg/mol-Ag of chloroauric acid and 7 mg/mol-Ag of sodium benzenethiosulfonate were added to the emulsion, followed by heating at 60° C for 45 minutes to conduct chemical sensitization. Then, 150 mg/mol-Ag of 1,3,3a,7-tetraazaindene (as a stabilizer), proxel and phenoxyethanol were added thereto, whereby an emulsion containing cubic silver chlorobromide grains having an average grain size of 0.28 μm, a coefficient of variation of 9% and a silver chloride content of 70 mol%, was obtained.

Coating of First Light-Sensitive Emulsion Layer

To Light-Sensitive Emulsion A were added $1\times10^{-3}$ mol/mol-Ag of 5-[3-(4-sulfobutyl)-5-chloro-2-oxazolidene]-1-hydroxyethyl-3-(2-pyridyl)-2-thiohydantion as a sensitizing dye. Then, $2\times10^{-4}$ mol/mol-Ag of 1-phenyl-5-mercaptotetrazole, $5\times10^{-4}$ mol/mol-Ag of Short Wavelength Cyanine Dye Compound (a) shown below, 200 mg/m² of Polymer Compound (b) shown below, 50 mg/m² of hydroquinone, 200 mg/m² of polyethyl acrylate dispersion, 200 mg/m² of 1,3-bisvinylsulfonyl-2-propanol as a hardener and $2.8\times10^{-5}$ mol/m² of Hydrazine Compound (c). The mixture was coated in a silver coating amount of 3.6 g/m² and in a gelatin coating amount of 2.0 g/m² in the manner described hereinafter.

Cyanine Dye Compound (a)

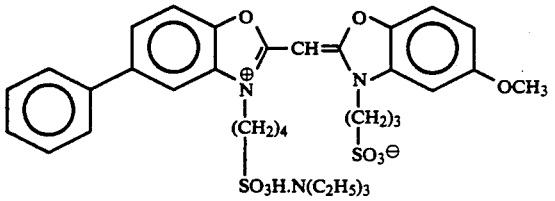

-continued

Polymer Compound (b)

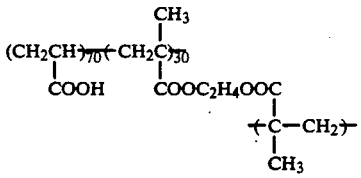

Hydrazine Compound (c) $2.8\times10^{-5}$ mol/m²

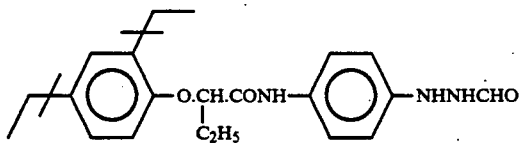

Coating of Intermediate Layer

| | |
|---|---|
| Gelatin | 1.0 g/m² |
| 1,3-Bisvinylsulfonyl-2-propanol | 4.0% by weight based on gelatin |

Second Light Sensitive Emulsion Layer

Preparation of Light-Sensitive Emulsion B

An aqueous solution containing 1.0 M of silver nitrate and an aqueous halide solution containing $3\times10^{-7}$ mol/mol Ag of $(NH_4)_3RhCl_6$, 0.3 M of potassium bromide and 0.74 M of sodium chloride were added to an aqueous gelatin solution containing sodium chloride and 1,3-dimethyl-2-imidazolidinethione at 45° C. with stirring over a period of 30 minutes by a double jet process. Silver chlorobromide grains having an average grain size of 0.28 μm and a silver chloride content of 70 mol% were obtained. The resulting emulsion was washed by a flocculation method in a conventional manner, and 40 g of gelatin was added thereto. After adjusting the pH to 6.5 and the pAg to 7.5, 5 mg/mol-Ag of sodium thiosulfate and 8 mg/mol-Ag of chloroauric acid were added to the emulsion, followed by heating at 60° C. for 60 minutes to conduct chemical sensitization. Then 150 mg/mol Ag of 1,3,3a,7-tetraazaindene (as a stabilizer) was added thereto, whereby an emulsion containing cubic silver chlorobromide grains having an average grain size of 0.28 μm, a coefficient of variation of 10% and a silver chloride content of 70 mol% was obtained.

Coating of Second Light-Sensitive Emulsion Layer

To Light-Sensitive Emulsion B were added $1\times10^{-3}$ mol/mol-Ag of 5-[3-(4-sulfobutyl)-5-chloro-2-oxazolidene]-1-hydroxyethyl-3 (2-pyridyl)-2-thiohydantion as a sensitizing dye and an aqueous solution containing $1\times10^{-3}$ mol/mol Ag of potassium iodide, then $2\times10^{-4}$ mol/mol-Ag of 1-phenyl-5-mercaptotetrazole, 50 mg/m² of polyethyl acrylate dispersion, 4.0% by weight of 1,3-bisvinylsulfonyl-2-propanol based on gelatin as a hardener and $1.0\times10^{-4}$ mol/m² of the redox compound of the present invention or the comparative compound shown in Table 1 below. The mixture was coated in a silver coating amount of 0.4 g/m² and in a gelatin coating amount of 0.5 g/m² in the manner described hereinafter.

Coating of Protective Layer

On the emulsion layer was coated a protective layer comprising 1.5 g/m² of gelatin and 0.3 g/m² of polymethyl methacrylate particles (average particle size: 2.5 μm) using the surfactants shown below.

| Surfactants | |
|---|---|
| 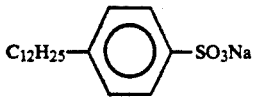 | 37 mg/m² |
| $CH_2COOC_6H_{13}$<br>\|<br>$CHCOOC_6H_{13}$<br>\|<br>$SO_3Na$ | 37 mg/m² |

-continued

| Surfactants | |
|---|---|
| $C_8F_{17}SO_2N(C_3H_7)CH_2COOK$ | 2.5 mg/m² |

Coating of Back Layer and Back Protective Layer

A back layer and a back protective layer each having the composition shown below were coated.

| Composition of Back Layer | |
|---|---|
| Gelatin | 3 g/m² |
| Polyethyl acrylate latex | 2 g/m² |
| Sodium p-dodecylbenzenesulfonate | 40 mg/m² |
| Gelatin hardener | 110 mg/m² |
| $(CH_2{=}CHSO_2CH_2CONH)_2(CH_2)_2$ | |
| Dye (a) | 50 mg/m² |
| 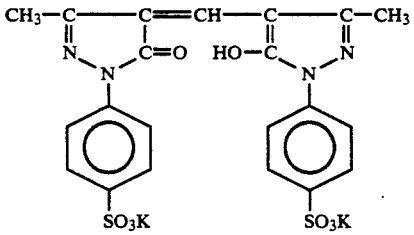 | |
| Dye (b) | 100 mg/m² |
| 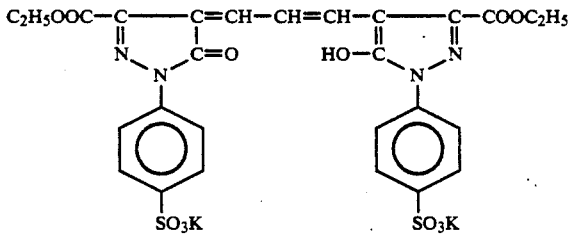 | |
| Dye (c) | 50 mg/m² |
| 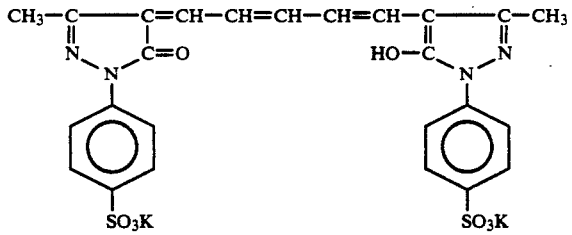 | |

| Composition of Back Protective Layer | |
|---|---|
| Gelatin | 0.8 g/m² |
| Polymethyl methacrylate particles (average particle size: 4.5 μm) | 30 mg/m² |
| Sodium dihexyl-α-sulfosuccinate | 15 mg/m² |
| Sodium dodecylbenzenesulfonate | 15 mg/m² |
| Sodium acetate | 40 mg/m² |
| Fluorine type surfactante $C_8F_{17}SO_2N(C_3H_7)CH_2COOK$ | 5 mg/m² |

On a polyester film support (thickness: 100 μm) were coated simultaneously the first light-sensitive emulsion layer as the undermost layer, the intermediate layer, the second light-sensitive emulsion layer containing a redox compound or a comparative compound and the protective layer to prepare the samples shown in Table 1 below.

Test 1

Each of the samples shown in Table 1 below was exposed through an optical wedge and a contact screen ("150L chain dot type", manufactured by Fuji Photo Film Co., Ltd.) using a tungsten light of a color temperature 3200° K., and then developed for 30 seconds at 34° C. in Developing Solution A described below, fixed, washed with water and dried.

| Developing Solution A | |
|---|---|
| Hydroquinone | 50.0 g |
| N-Methyl-p-aminophenol | 0.3 g |
| Sodium Hydroxide | 18.0 g |
| 5-Sulfosalicylic Acid | 55.0 g |
| Potassium Sulfite | 24.0 g |
| Disodium Ethylenediaminetetraacetate | 1.0 g |
| Potassium Bromide | 10.0 g |
| 5-Methylbenzotriazole | 0.4 g |
| 2-Mercaptobenzimidazole-5-sulfonic Acid | 0.3 g |
| Sodium 3-(5-Mercaptotetrazole)benzene-Sulfonate | 0.2 g |
| N-n-Butyldiethanolamine | 15.0 g |
| Sodium Toluenesulfonate | 8.0 g |
| Water to make | 1 l |
| pH adjusted to 11.6 (by adding potassium hydroxide) | pH 11.6 |

The dot gradation was expressed by the following equation:

Dot Gradation ($\Delta \log E$) = Exposure Amount Providing a Dot Area Ratio of 95% ($\log E_{95\%}$) − Exposure Amount Providing a Dot Area Ratio of 5% ($\log E_{5\%}$)

The average gradation was expressed by the following equation:

Average Gradation ($\overline{G}$) = Value obtained by dividing 2.7 by a value of [log(exposure amount providing density of 3.0) − log (exposure amount providing density of 0.3)]

The dot quality was visually evaluated in five ranks, with "5" meaning the best, and "1" meaning the worst. The rank of "5" or "4" indicates that the sample is practically suitable as a dot image original for photomechanical processes; the rank "3" indicates that the sample is on the limit for practical use; and the rank "2" or "1" indicates that the sample is impractical.

The results obtained are shown in Table 1 below.

TABLE 1

| No. | Sample No. | | Redox Compound | | Average Gradation (G) | Dot Gradation (Δlog E) | Dot Quality |
|---|---|---|---|---|---|---|---|
| 1 | Comparative Sample | 1-a | — | | 15.1 | 1.21 | 3 |
| 2 | Comparative Sample | 1-b | Comparative Compound | A | 14.2 | 1.29 | 4 |
| 3 | Comparative Sample | 1-c | Comparative Compound | B | 16.5 | 1.24 | 3 |
| 4 | Comparative Sample | 1-d | Comparative Compound | C | 15.9 | 1.20 | 3 |
| 5 | Comparative Sample | 1-e | Comparative Compound | D | 14.0 | 1.28 | 4 |
| 6 | Comparative Sample | 1-f | Comparative Compound | E | 15.3 | 1.43 | 5 |
| 7 | Comparative Sample | 1-g | Comparative Compound | F | 14.9 | 1.41 | 5 |
| 8 | Comparative Sample | 1-h | Comparative Compound | G | 17.1 | 1.42 | 5 |
| 9 | Comparative Sample | 1-i | Comparative Compound | H | 9.8 | 1.40 | 4.5 |
| 10 | Sample of Invention | 1-1 | Compound | 3 | 14.9 | 1.48 | 5 |
| 11 | Sample of Invention | 1-2 | Compound | 7 | 17.2 | 1.44 | 5 |
| 12 | Sample of Invention | 1-3 | Compound | 8 | 16.8 | 1.42 | 5 |
| 13 | Sample of Invention | 1-4 | Compound | 9 | 15.3 | 1.50 | 5 |
| 14 | Sample of Invention | 1-5 | Compound | 10 | 14.7 | 1.51 | 5 |
| 15 | Sample of Invention | 1-6 | Compound | 11 | 15.1 | 1.47 | 5 |
| 16 | Sample of Invention | 1-7 | Compound | 17 | 15.9 | 1.46 | 5 |
| 17 | Sample of Invention | 1-8 | Compound | 18 | 17.0 | 1.45 | 5 |
| 18 | Sample of Invention | 1-9 | Compound | 23 | 16.3 | 1.43 | 5 |

Comparative Compound A

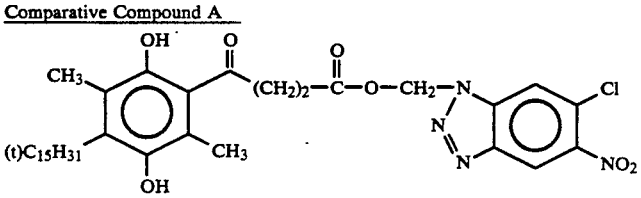

(Compound 28 described in JP-A-61-213847)

Comparative Compound B

-continued

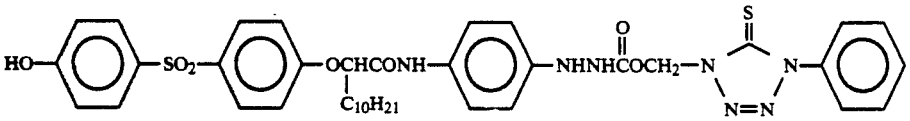

(Compound 2 described in JP-A-62-260153)

Comparative Compound C

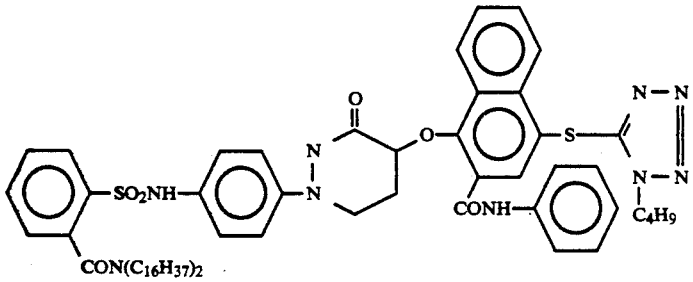

(Compound 10 described in JP-A-64-88451)

Comparative Compound D

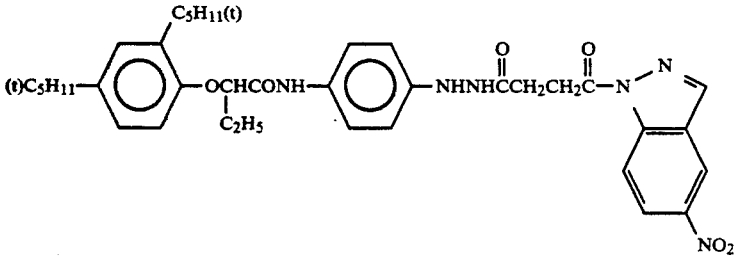

(Compound 13 described in JP-A-64-72140)

Comparative Compound E

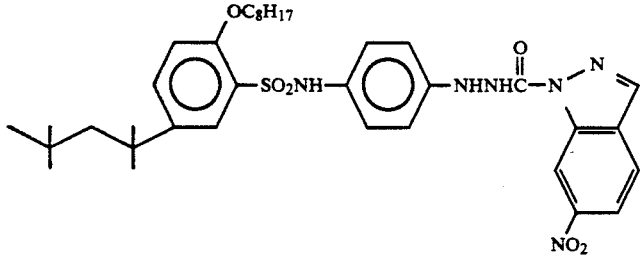

(Compound 17 described in Japanese Patent Application No. 2-62337)

Comparative Compound F

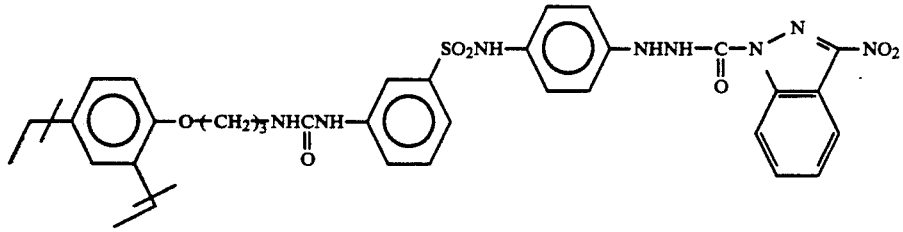

(Compound 14 described in Japanese Patent Application No. 2-62337)

Comparative Compound G

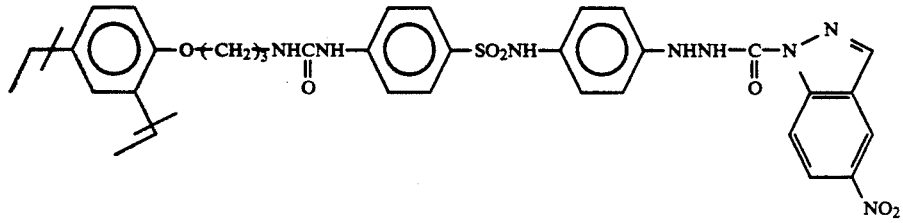

(Compound 18 described in Japanese Patent Application No. 2-62337)

-continued

Comparative Compound H

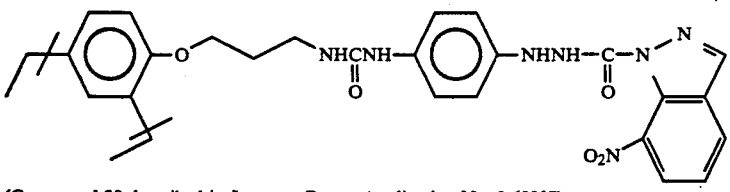

(Compound 20 described in Japanese Patent Application No. 2-62337)

From the results shown in Table 1, it can be seen that Comparative Samples 1-f, 1-g and 1-h and all samples according to the present invention exhibit broad dot gradation and high dot quality while maintaining good gradation, but Comparative Sample 1-i has very poor gradation although it has broad dot gradation.

Test 2

Each of the 18 samples used in Test 1 was subjected to the development processing described below to prepare Fatigued Developing Solutions B-1 to B-18.

Development Conditions 200 samples of 50.8 cm×61 cm were exposed to light at a blackening ratio of 80% and developed with 20 liters of Developing Solution A at 34° C. for one day at a developing speed of one sample per 30 seconds.

Using Developing Solution A and each of Fatigued Developing Solutions B-1 to B-18, each of the 18 samples was subjected to light exposure and development processing in the same manner as described in Test 1. The difference in photographic sensitivities ($\Delta\log E_1$) obtained by using Developing Solution A and each of Fatigued Developing Solutions B-1 to B-18 was determined with each sample. The photographic sensitivity (logE) was a logarithm of exposure amount necessary for providing a density of 1.5.

The results obtained are shown in Table 2 below.

Furthermore, using Developing Solution A and each of Fatigued Developing Solutions B-1 to B-18, GRANDEX Film GA 100 manufactured by Fuji Photo Film Co., Ltd. was subjected to light exposure and development processing in the same manner as described in Test 1. The difference in photographic sensitivities ($\Delta\log E_2$) obtained by using Developing Solution A and each of Fatigued Developing Solutions B-1 to B-18 was determined with each sample.

The results obtained are also shown in Table 2 below.

TABLE 2

| No. | Sample No. | | Fatigued Developing Solution | Change in Photographic Sensitivity: Each of 18 Samples ($\Delta\log E_1$) | Change in Photographic Sensitivity: GRANDEX Film GA 100 ($\Delta\log E_2$) |
|---|---|---|---|---|---|
| 1 | Comparative Sample | 2-a | B1 | −0.06 | −0.08 |
| 2 | Comparative Sample | 2-b | B2 | −0.30 | −0.34 |
| 3 | Comparative Sample | 2-c | B3 | −0.28 | −0.31 |
| 4 | Comparative Sample | 2-d | B4 | −0.25 | −0.30 |
| 5 | Comparative Sample | 2-e | B5 | −0.33 | −0.35 |
| 6 | Comparative Sample | 2-f | B6 | −0.29 | −0.33 |
| 7 | Comparative Sample | 2-g | B7 | −0.31 | −0.35 |
| 8 | Comparative Sample | 2-h | B8 | −0.29 | −0.32 |
| 9 | Comparative Sample | 2-i | B9 | −0.08 | −0.09 |
| 10 | Sample of Invention | 2-1 | B10 | −0.05 | −0.08 |
| 11 | Sample of Invention | 2-2 | B11 | −0.06 | −0.09 |
| 12 | Sample of Invention | 2-3 | B12 | −0.08 | −0.10 |
| 13 | Sample of Invention | 2-4 | B13 | −0.07 | −0.08 |
| 14 | Sample of Invention | 2-5 | B14 | −0.06 | −0.09 |
| 15 | Sample of Invention | 2-6 | B15 | −0.05 | −0.07 |
| 16 | Sample of Invention | 2-7 | B16 | −0.05 | −0.08 |
| 17 | Sample of Invention | 2-8 | B17 | −0.08 | −0.10 |
| 18 | Sample of Invention | 2-9 | B18 | −0.09 | −0.11 |

As is apparent from the results shown in Table 2, the samples according to the present invention and Comparative Sample 2-i exhibit a very small change in photographic sensitivity which is the same level as in Comparative Sample 2-a containing no redox compound. On the contrary, Comparative Samples 2-b to 2-h show a large change in photographic sensitivity. This is because of the decrease in activity of the developing solution employed.

Thus, the samples of the present invention is superior to the comparative samples with respect to both the results of Tables 1 and 2.

EXAMPLE 2

Preparation of Light-Sensitive Emulsion C

An aqueous solution of silver nitrate and an aqueous solution of sodium chloride were added simultaneously to an aqueous gelatin solution maintained at 50° C. in the presence of $5.0\times10^{-6}$ mol/mol-Ag of $(NH_4)_3RhCl_6$ After removing the soluble salts by a method well known in the art, gelatin was added to the emulsion. Then, 6-methyl-4-hydroxy-1,3,3a,7 tetraazaindene was added thereto as a stabilizer without conducting chemical sensitization. Thus, a cubic monodispersed emulsion having an average grain size of 0.15 μm was obtained.

Coating of Light-Sensitive Emulsion Layer

First Layer

To Light-Sensitive Emulsion C were added 75 mg/m$^2$ of Hydrazine Compound 4-8, $5\times10^{-3}$ mol/mol-Ag of 5-methylbenzotriazole, 30% by weight of polyethyl acrylate latex based on gelatin and 2.0% by weight of 1,3-bisvinylsulfonyl-2-propanol based on gelatin. The mixture was coated in a silver coating amount of 3.5 g/m$^2$ and in a gelatin coating amount of 2 g/m$^2$.

Second Layer

| Second Layer: | |
|---|---|
| Gelatin | 1.0 g/m$^2$ |

Third Layer

To Light-Sensitive Emulsion C were added $5\times10^{-3}$ mol/mol-Ag of 5-methylbenzotriazole, 30% by weight of polyethyl acrylate latex based on gelatin and 2.0% by weight of 1,3-bisvinylsulfonyl-2-propanol based on gelatin and the redox compound of the present invention or the comparative compound shown in Table 3 below. The mixture was coated in a silver coating amount of 0.4 g/m$^2$ and in a gelatin coating amount of 0.5 g/m$^2$.

Fourth Layer

A protective layer containing 1.5 g/m$^2$ of gelatin, 0.3 g/m$^2$ of polymethyl methacrylate particles (average particle size: 2.5 μm) as a matting agent, surfactants as coating aids, stabilizer and ultraviolet absorbing dye each described below, was coated and dried.

Surfactants

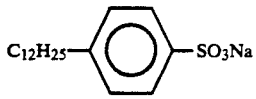

37 mg/m$^2$ $CH_2COO_6H_{13}$
|
$CHCOOC_6H_{13}$
|
$SO_3Na$ 37 mg/m$^2$ $C_8F_{17}SO_2N(C_3H_7)CH_2COOK$ 2.5 mg/m$^2$

Stabilizer

Thioctic acid 2.1 mg/m$^2$

Ultraviolet Absorbing Agent 100 mg/m$^2$

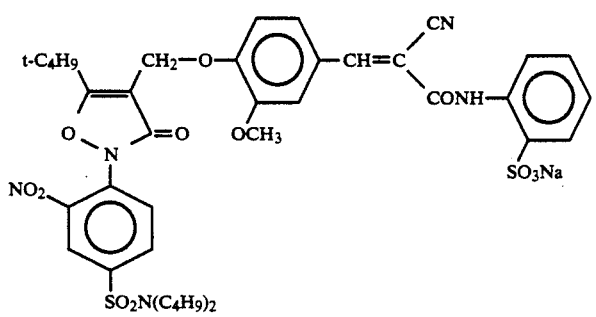

Each of these samples thus prepared was exposed to light using a bright room type printer P-607 (manufactured by Dainippon Screen Mfg. Co., Ltd.) through the original as illustrated in FIG. 1 of JP-A-1-240966, developed at 38° C. for 20 seconds, fixed, washed with water and dried.

The quality of the thus obtained letter images was evaluated. The quality "5" of letter images refers to such a quality that when the original as illustrated in FIG. 1 of JP A-1-240966 and a contact-type light-sensitive material were arranged, and correct exposure was applied thereto by which 50% dot area on the halftone original could be reproduced as 50% dot area on the light-sensitive material, was given, letter images having a line width of 30 μm could be reproduced on the light-sensitive material, that is to say, very excellent quality. On the other hand, the quality "1" of letter images refers to such a quality that when the same correct exposure as described above was applied, letter images having a line width of 150 μm or more could barely be reproduced, that is, the quality was quite inferior. The three ranks 4, 3, and 2 were designated between the quality "5" and the quality "1" on a basis of sensory evaluation. The ranks 3 or higher were practical.

The results obtained are shown in Table 3 below.

TABLE 3

| No. | Sample No. | | Redox Compound | | Amount Added (mol/m$^2$) | Quality of Letter Image |
|---|---|---|---|---|---|---|
| 1 | Comparative Sample | 3-a | — | | — | 2 |
| 2 | Comparative Sample | 3-b | Comparative Compound | A | $1.0\times10^{-4}$ | 2 |
| 3 | Sample of Invention | 3-1 | Compound | 3 | $1.0\times10^{-4}$ | 5 |
| 4 | Sample of Invention | 3-2 | Compound | 7 | $1.0\times10^{-4}$ | 4.5 |
| 5 | Sample of Invention | 3-3 | Compound | 9 | $1.0\times10^{-4}$ | 5 |
| 6 | Sample of Invention | 3-4 | Compound | 10 | $1.0\times10^{-4}$ | 5 |

TABLE 3-continued

| No. | Sample No. | | Redox Compound | | Amount Added (mol/m$^2$) | Quality of Letter Image |
|---|---|---|---|---|---|---|
| 7 | Sample of Invention | 3-5 | Compound | 11 | $1.0 \times 10^{-4}$ | 5 |
| 8 | Sample of Invention | 3-6 | Compound | 17 | $1.0 \times 10^{-4}$ | 4.5 |
| 9 | Sample of Invention | 3-7 | Compound | 23 | $1.0 \times 10^{-4}$ | 5 |

From the results shown in Table 3, it can be seen that the samples of the present invention provide a letter image of good quality.

Further, as a result of the evaluation of photographic properties using the fatigued developing solution in the same manner as described in Test 2 of Example 1, it was found that the samples of the present invention exhibited good properties.

As described hereinbefore, silver halide photographic materials which provide high contrast images and good dot gradation, dot quality and letter image quality can be obtained using the compound represented by formula (I) according to the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer, wherein the silver halide photographic material contains at least one compound represented by formula (I):

$$\mathrm{ED}\text{-}(\mathrm{Time})_t\text{-}\mathrm{Ind} \qquad \text{(I)}$$

wherein ED represents a group capable of releasing $(\mathrm{Time})_t$-Ind upon a reaction with an oxidation product of a developing agent; Time represents a divalent linking group; t represents 0 or 1; and Ind represents a group represented by formula (II):

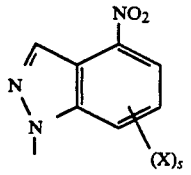

(II)

wherein X represents a monovalent group; and s represents an integer of from 0 to 4.

2. A silver halide photographic material as claimed in claim 1, wherein the group represented by ED is a redox group which releases $(\mathrm{Time})_t$-Ind upon being oxidized by an oxidation product of a developing agent.

3. A silver halide photographic material as claimed in claim 2, wherein the redox group contains a hydrazine moiety.

4. A silver halide photographic material as claimed in claim 1, wherein the compound represented by formula (I) is a compound represented by formula (III):

$$R_1\text{-}\underset{\underset{A_1}{|}}{N}\text{-}\underset{\underset{A_2}{|}}{N}\text{-}G_1\text{-}(\mathrm{Time})_t\text{-}\mathrm{Ind} \qquad \text{(III)}$$

wherein Time, t and Ind each has the same meaning as defined in formula (I); $R_1$ represents an aliphatic group or an aromatic group; $G_1$ represents —CO—, —CO-CO—, —CS—, $$\underset{\underset{N-G_2-R_2}{\|}}{-C-}\ ,\ -SO-,\ -SO_2- \text{ or } -\overset{\overset{O}{\|}}{\underset{\underset{G_2-R_2}{|}}{P}}-\ ;$$

$G_2$ represents a a mere bond, —O—, —S— or $$-\underset{\underset{R_2}{|}}{N}-;$$

$R_2$ represents a hydrogen atom, an aliphatic group or an aromatic group and when two or more $R_2$ groups are present, they may be the same or different; and one of $A_1$ and $A_2$ represents a hydrogen atom; and the other represents a hydrogen atom, an acyl group, an alkylsulfonyl group or an arylsulfonyl group.

5. A silver halide photographic material as claimed in claim 4, wherein $R_1$ is an aryl group.

6. A silver halide photographic material as claimed in claim 4, wherein $G_1$ is —CO—.

7. A silver halide photographic material as claimed in claim 4, wherein $A_1$ and $A_2$ are hydrogen atoms.

8. A silver halide photographic material as claimed in claim 1, wherein s is 0, 1 or 2.

9. A silver halide photographic material as claimed in claim 1, wherein the monovalent group represented by X is selected from an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxy group, a phosphonamido group, a nitro group and a nitroso group 10. A silver halide photographic material as claimed in claim 4, wherein $R_1$ or Time has a ballast group or an adsorption accelerating group for silver halide.

11. A silver halide photographic material as claimed in claim 1, wherein the compound represented by formula (I) is present in a silver halide emulsion layer or another hydrophilic colloid layer.

12. A silver halide photographic material as claimed in claim 1, wherein a different hydrazine compound from the compound represented by formula (I) is further incorporated into a silver halide emulsion layer or another hydrophilic colloid layer.

13. A silver halide photographic material as claimed in claim 12, wherein the different hydrazine compound is a compound represented by formula (IV):

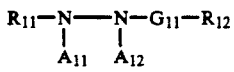

(IV)

wherein $R_{11}$ represents an aliphatic group or an aromatic group; $R_{12}$ represents a hydrogen atom, an alkyl group, an aryl group, an alkoxyl group, an aryloxy group, an amino group or a hydrazino group; $G_{11}$ represents —CO—, —$SO_2$—, —SO—,

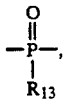

—COCO—, a thiocarbonyl group or an iminomethylene group; $A_{11}$ and $A_{12}$ each represents a hydrogen atom, or one of $A_{11}$ and $A_{12}$ represents a hydrogen atom and the other represents a substituted or unsubstituted alkylsulfonyl group, a substituted or unsubstituted arylsulfonyl group, or a substituted or unsubstituted acyl group; and $R_{13}$ has the same meaning as defined for $R_{12}$ and may be the same as or different from $R_{12}$.

14. A silver halide photographic material as claimed in claim 12, wherein the compound represented by formula (I) and the different hydrazine compound are present in different layers.

* * * * *